US011384910B1

(12) United States Patent
Cohen

(10) Patent No.: US 11,384,910 B1
(45) Date of Patent: Jul. 12, 2022

(54) LIGHT FIXTURE

(71) Applicant: Brandon Cohen, Vernon, CA (US)

(72) Inventor: Brandon Cohen, Vernon, CA (US)

( * ) Notice: Subject to any disclaimer, the term of this patent is extended or adjusted under 35 U.S.C. 154(b) by 0 days.

(21) Appl. No.: 17/246,272

(22) Filed: Apr. 30, 2021

Related U.S. Application Data

(63) Continuation-in-part of application No. 29/775,487, filed on Mar. 23, 2021, and a continuation-in-part of application No. 29/775,488, filed on Mar. 23, 2021.

(51) Int. Cl.

| | |
|---|---|
| ***F21S 8/02*** | (2006.01) |
| ***F21V 21/04*** | (2006.01) |
| ***F21V 29/77*** | (2015.01) |
| ***F21V 23/04*** | (2006.01) |
| *H05B 45/20* | (2020.01) |
| *F21Y 115/10* | (2016.01) |

(52) U.S. Cl.
CPC ..... *F21S 8/02* (2013.01); *F21V 21/047* (2013.01); *F21V 23/04* (2013.01); *F21V 29/777* (2015.01); *F21Y 2115/10* (2016.08); *H05B 45/20* (2020.01)

(58) Field of Classification Search
CPC ..... F21S 8/02; F21S 8/00; F21S 8/04; F21S 8/026; F21S 8/03; F21S 8/033; F21V 29/777; F21V 21/047; F21V 23/04; F21V 21/04; F21V 21/041; F21V 29/503; F21V 29/508; F21V 29/70; F21Y 2115/10; H05B 45/20
See application file for complete search history.

(56) References Cited

U.S. PATENT DOCUMENTS

| | | | | |
|---|---|---|---|---|
| D606,696 | S | 12/2009 | Chen | |
| D640,819 | S | 6/2011 | Pan | |
| 7,959,332 | B2 * | 6/2011 | Tickner | F21S 8/026 362/345 |
| D656,263 | S | 3/2012 | Ogawa | |

(Continued)

OTHER PUBLICATIONS

DMF DRD2 Product Publicly available at least as early as Sep. 6, 2018 Website: https://www.dmflighting.com/product/drd2/.

(Continued)

*Primary Examiner* — Bao Q Truong
(74) *Attorney, Agent, or Firm* — Eric Kelly

(57) ABSTRACT

A light fixture is configured for mounting within a given housing-can. The light fixture may have a driver assembly, a heat-sink and a trim-casing assembly. The driver assembly may have a driver-printed-circuit-board, a lumen-switch, a color-temperature-switch, and a driver-box. The driver-printed-circuit-board, the lumen-switch, and the color-temperature-switch may be at least partially housed within the driver-box. With the lumen-switch, a lumen output of the light fixture may be selected. With the color-temperature-switch, a light color-temperature output of the light fixture may be selected. The trim-casing assembly may have a light-emitting-diode-circuit, a reflector, a lens, a can-attachment-means, and a trim-casing-member. The light-emitting-diode-circuit, the reflector, and the lens may be housed within the trim-casing-member. The can-attachment-means may be attached to an exterior of the trim-casing-member and is for attaching the light fixture to the housing-can. The heat-sink may be disposed between the driver assembly and the trim-casing-assembly.

19 Claims, 20 Drawing Sheets

(56) References Cited

U.S. PATENT DOCUMENTS

| | | | | |
|---|---|---|---|---|
| D668,372 | S | 10/2012 | Renshaw | |
| D682,459 | S | 5/2013 | Gordin | |
| D694,456 | S | 11/2013 | Rowlette, Jr | |
| 8,641,243 | B1 * | 2/2014 | Rashidi | F21V 23/06 362/249.02 |
| D708,381 | S | 7/2014 | Rashidi | |
| D714,989 | S | 10/2014 | Rowlette, Jr | |
| D726,949 | S | 4/2015 | Redfern | |
| 9,039,254 | B2 | 5/2015 | Danesh | |
| D734,525 | S | 7/2015 | Gordin | |
| 9,404,639 | B2 | 8/2016 | Bailey | |
| D777,967 | S | 1/2017 | Redfern | |
| D779,100 | S | 2/2017 | Redfern | |
| 9,581,302 | B2 | 2/2017 | Danesh | |
| D790,102 | S | 6/2017 | Guzzini | |
| 9,702,516 | B1 * | 7/2017 | Vasquez | F21V 29/70 |
| 9,964,266 | B2 | 5/2018 | Danesh | |
| D820,494 | S | 6/2018 | Cohen | |
| 10,139,059 | B2 | 11/2018 | Danesh | |
| D847,414 | S | 4/2019 | Danesh | |
| D847,415 | S | 4/2019 | Danesh | |
| 10,408,395 | B2 | 9/2019 | Danesh | |
| 10,914,465 | B2 * | 2/2021 | Cohen | F21V 23/007 |
| 11,092,326 | B2 * | 8/2021 | Cohen | F21V 19/003 |
| 2015/0233556 | A1 | 8/2015 | Danesh | |
| 2017/0138576 | A1 | 5/2017 | Peng | |
| 2018/0231197 | A1 | 8/2018 | Danesh | |
| 2019/0049080 | A1 | 2/2019 | Danesh | |

OTHER PUBLICATIONS

DMF DRD4 Product Publicly available at least as early as Sep. 6, 2018 Website: https://www.dmflighting.com/product/drd4/.

ELCO E247 Product Publicly available at least as early as Sep. 6, 2018 See attached concurrently filed NPL document with two product images of this ELCO E247 Product.

SORAA LED Optical Light Engine See: https://res.cloudinary.com/soraa/image/upload/v1516986148/resources/misc/ole-more-info-pdf.pdf.

IMTRA Tide PowerLED Light Fixture See: https://www.imtra.com/1806fa8d-4593-40f4-bbf0-f9a833e92148/lighting-light-fixtures-detail.htm Publicly available at least as early as 2012.

ELCO 4' Round LED Reflector Insert Publicly available at least as early as Mar. 23, 2021 Website: https://elcolighting.com/products/4-round-led-reflector-insert.

ELCO 4' Five-Color Temperature Switch LED Reflector Inserts Publicly available at least as early as Mar. 23, 2021 Website: https://elcolighting.com/node/1432026.

* cited by examiner

LIGHT FIXTURE

PRIORITY NOTICE

The present patent application is a continuation-in-part (CIP) of U.S. non-provisional patent application Ser. No. 29/775,487 filed on Mar. 23, 2021, and claims priority to said U.S. non-provisional patent application under 35 U.S.C. § 120. The above-identified patent application is incorporated herein by reference in its entirety as if fully set forth below.

The present patent application is a continuation-in-part (CIP) of U.S. non-provisional patent application Ser. No. 29/775,488 filed on Mar. 23, 2021, and claims priority to said U.S. non-provisional patent application under 35 U.S.C. § 120. The above-identified patent application is incorporated herein by reference in its entirety as if fully set forth below.

TECHNICAL FIELD OF THE INVENTION

The present invention relates in general to light fixtures and more specifically to light fixtures that are configured to output luminosity and/or light color-temperature from within predetermined ranges of luminosity and/or light color-temperature.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

It is often desirable for different rooms or even different regions of a same room to have ceiling (or wall) mounted light fixtures that output light at a given luminosity and/or that output light at a given light color-temperature. For example, it may be desirable to output light differently in a kitchen, pantry, living room, dining room, lounge, entertainment room, media room, great room, hallway, flex room, gym, studio, bathroom, bedroom, study, foyer, office, lab, work area, waiting room, mud room, garage, shop, deck, porch, patio, portions thereof, combinations thereof, and/or the like. It would be desirable if a single type of light fixture was capable of outputting light at different lumens and/or was capable of outputting light at different light color-temperatures. It would be further desirable if the different outputs of lumens and/or the different outputs of light color-temperature were selectable via one or more switches of that single type of light fixture. Thus, such a single type of light fixture could be used in multiple locations in different rooms and/or within the same room to achieve different lighting effects. Having such a single type of light fixture could avoid needing to use a variety of different types of light fixtures, wherein each different type of light fixture only has a light output of a single specific luminosity and/or that has a light output of a single specific light color-temperature.

It is to these ends that the present invention has been developed.

BRIEF SUMMARY OF THE INVENTION

To minimize the limitations in the prior art, and to minimize other limitations that will be apparent upon reading and understanding the present specification, the present invention may describe various light fixtures. In some embodiments, a given light fixture may be configured for (removably) mounting within a given housing-can. In some embodiments, the light fixture may comprise a driver assembly, a heat-sink and a trim-casing assembly. In some embodiments, the driver assembly may comprise a driver-printed-circuit-board, a lumen-switch, a color-temperature-switch, and a driver-box. In some embodiments, the driver-printed-circuit-board, the lumen-switch, and the color-temperature-switch may be at least partially housed within the driver-box. In some embodiments, with the lumen-switch, a lumen output of the light fixture may be selected. In some embodiments, with the color-temperature-switch, a light color-temperature output of the light fixture may be selected. In some embodiments, the trim-casing assembly may comprise a light-emitting-diode-circuit, a reflector, a lens, a can-attachment-means, and a trim-casing-member. In some embodiments, the light-emitting-diode-circuit, the reflector, and the lens may be housed within the trim-casing-member. In some embodiments, the can-attachment-means may be attached to an exterior of the trim-casing-member and may be configured for attaching the light fixture to the housing-can. In some embodiments, the heat-sink may be disposed entirely below the driver assembly and entirely or at least partially above the trim-casing-assembly.

It is an objective of the present invention to provide a light fixture for (removable) mounting within a housing-can.

It is another objective of the present invention to provide a light fixture with a lumen output selection switch.

It is another objective of the present invention to provide a light fixture that is configured to output light at different lumens from a range of predetermined lumens.

It is another objective of the present invention to provide a light fixture with a light color-temperature output selection switch.

It is another objective of the present invention to provide a light fixture that is configured to output light at different light color-temperatures from a range of predetermined light color-temperatures.

It is another objective of the present invention to provide a light fixture that is configured to receive and operate at a predetermined voltage.

It is another objective of the present invention to provide a light fixture that is configured to receive and operate at a predetermined wattage.

It is another objective of the present invention to provide a light fixture where a LED-chip/board, a reflector, and a lens are all entirely housed within a trim/casing member of the light fixture.

It is another objective of the present invention to provide a light fixture where a heat-sink is located entirely below a driver assembly and entirely above a trim-casing assembly.

It is yet another objective of the present invention to provide a light fixture where a heat-sink is located entirely below a driver assembly and partially above a trim-casing assembly (with the an upper-portion of the trim-casing assembly extending into a bottom inside of the heat-sink).

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1A:
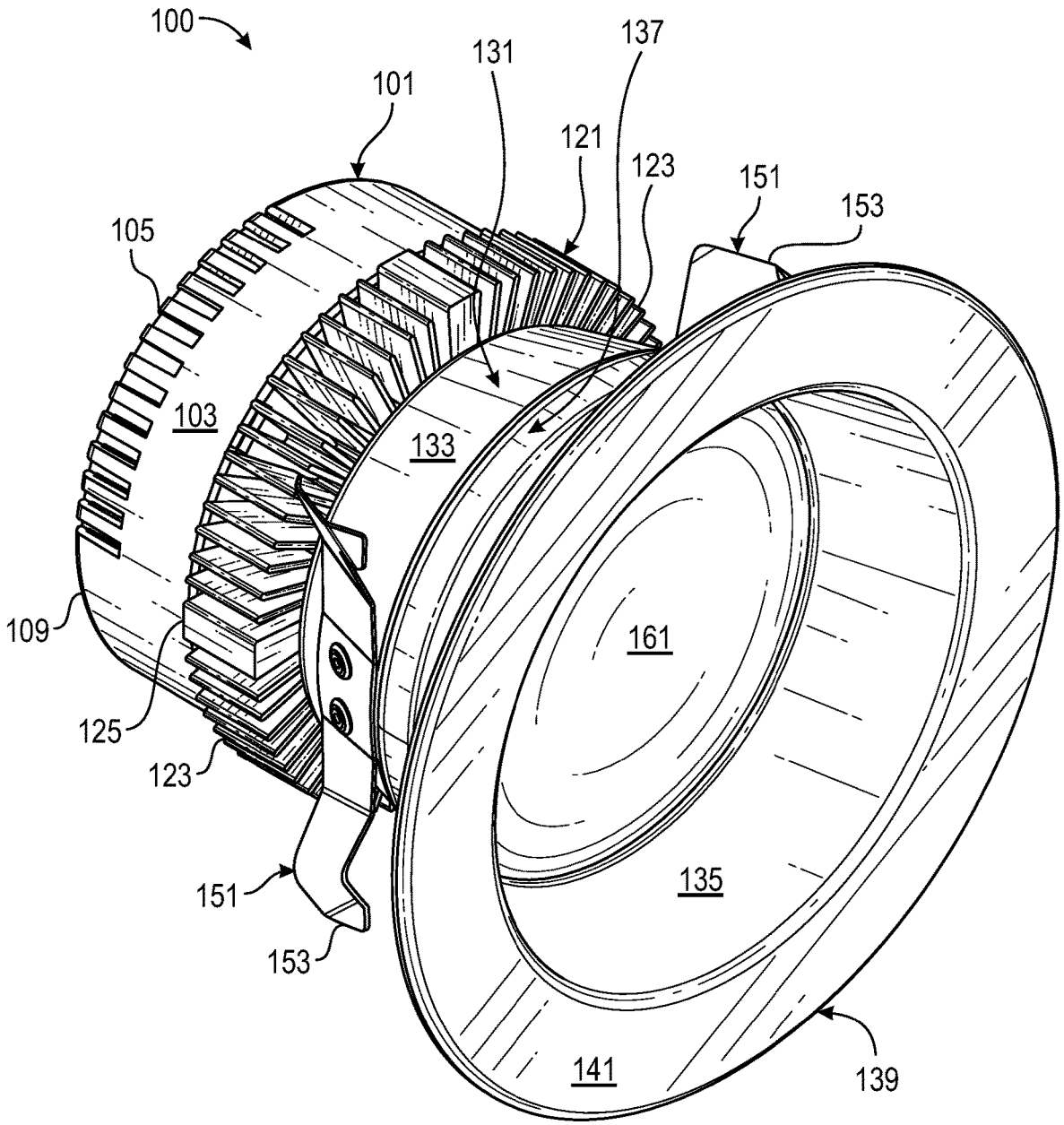
FIG. 1A depicts a bottom perspective view of a light fixture (in an assembled configuration).

100 light fixture 100
101 driver-box 101
103 side-wall 103
105 fin 105
107 notch 107
109 top 109
111 lumen-switch-cover 111
113 color-temperature-switch-cover 113
115 switch-aperture 115
117 indicia 117
121 heat-sink 121
123 fin-thin 123
125 fin-thick 125
131 trim/casing 131
133 conical-exterior 133
135 conical-interior 135
137 cylindrical-region 137
139 flange 139
141 flange-bottom 141
143 flange-top 143
145 flange-lip 145
147 flange-conical-transition 147
151 pressure-clip 151
153 wing 153
161 lens 161
201 common longitudinal center 201 (of light fixture 100 or of light fixture 400)
211 lumen-switch 211
213 color-temperature-switch 213
215 switch chassis 215
217 wiring/cabling 217
219 power connector 219
221 driver-PCB 221
231 driver-cap 231
241 LED chip/board 241
251 reflector 251
261 upper-portion 261 (of trim/casing 131 or of trim/casing 431)
263 top 263 (of trim/casing 131 or of trim/casing 431)
301 can/housing 301
303 power source 303
400 light fixture 400
421 heat-sink 421
423 fin-thin 423
425 fin-thick 425
431 trim/casing 431
433 upper-portion 433
451 torsion-spring 451
453 wing 453
601 can/housing 601
603 power source 603

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
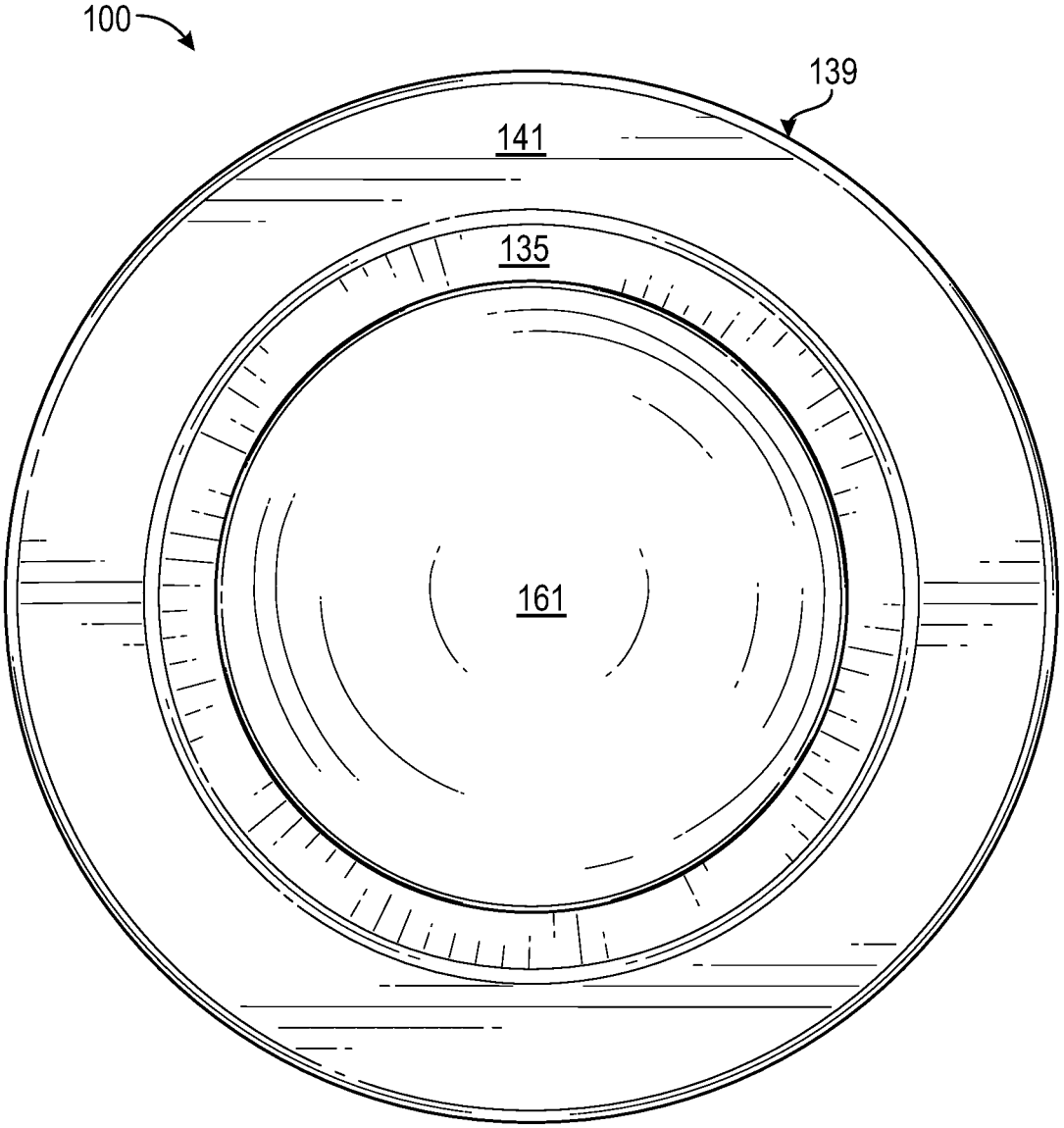
FIG. 1B depicts a bottom view of the light fixture of FIG. 1A (in an assembled configuration).
Figure 1C:
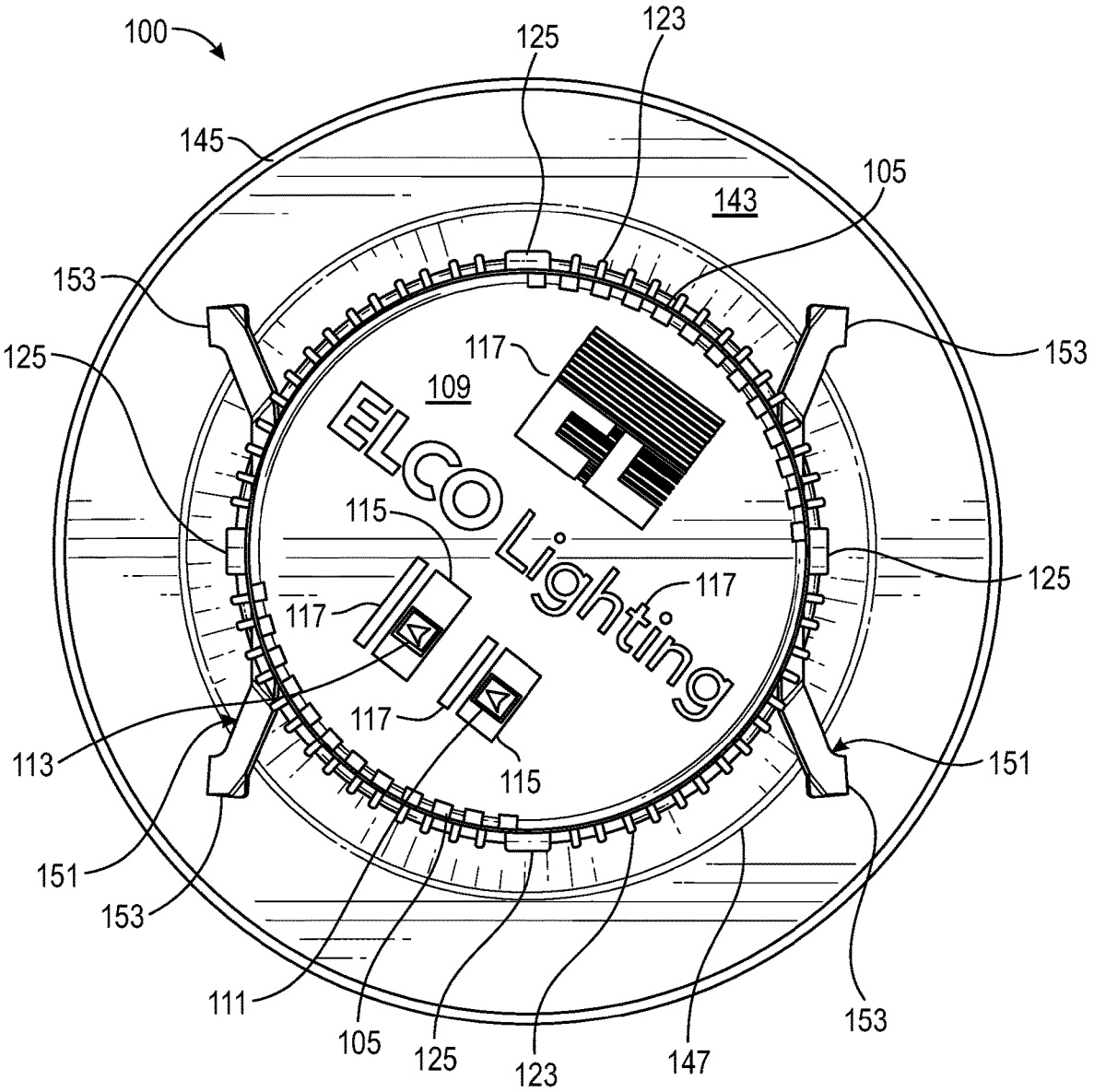
FIG. 1C depicts a top view of the light fixture of FIG. 1A (in an assembled configuration).
Figure 1D:
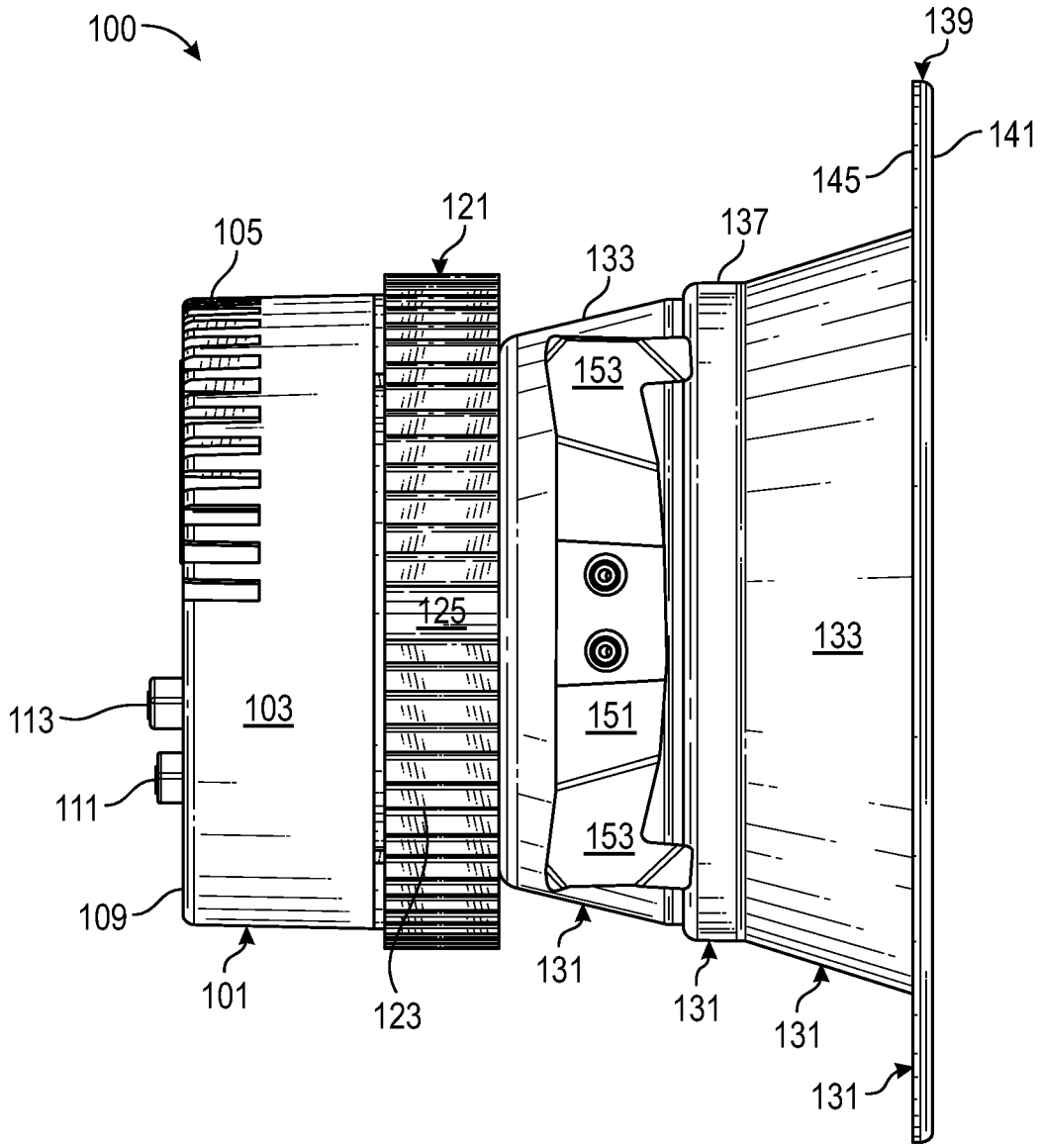
FIG. 1D depicts a right-side view of the light fixture of FIG. 1A (in an assembled configuration).
Figure 1E:
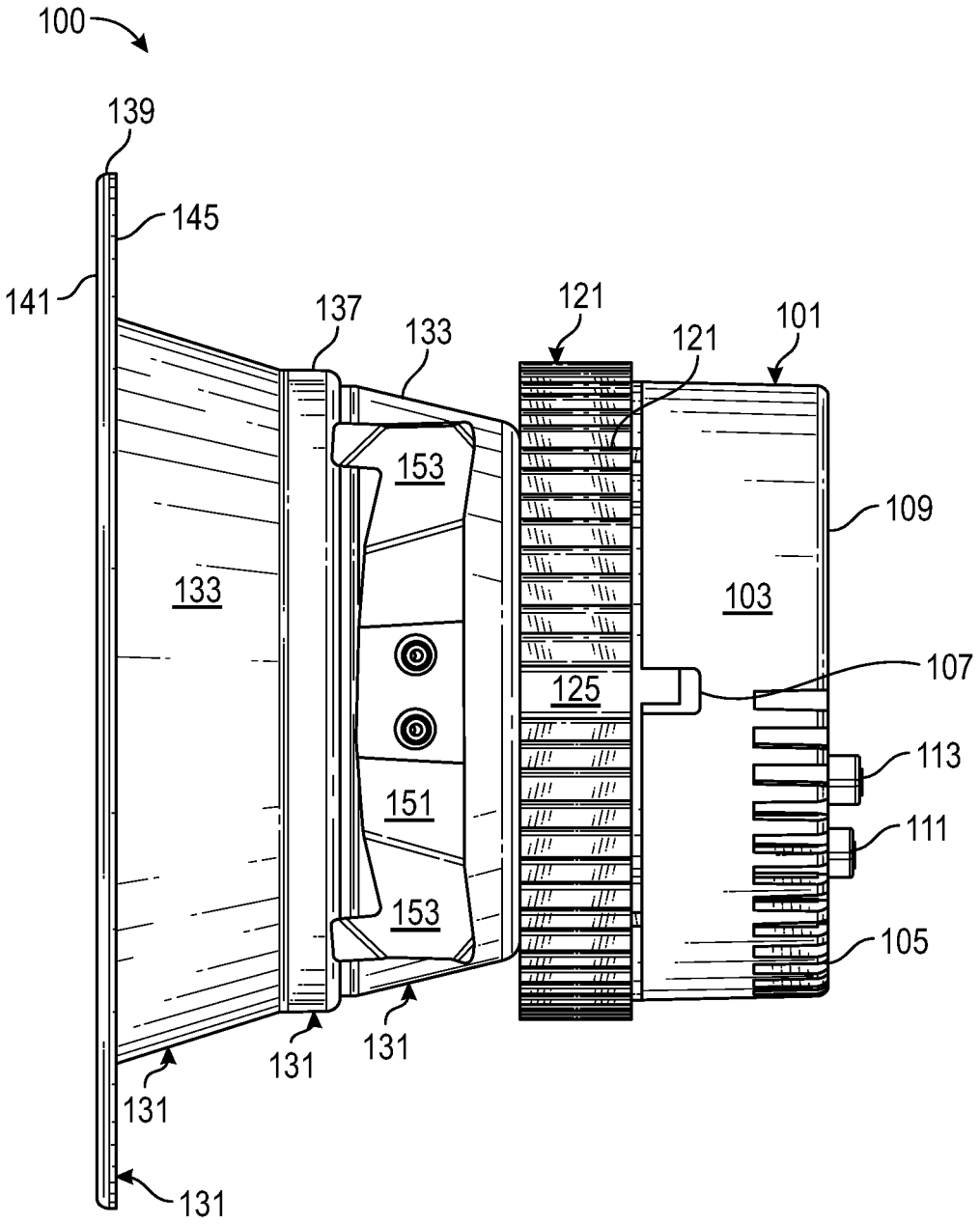
FIG. 1E depicts a left-side view of the light fixture of FIG. 1A (in an assembled configuration).
Figure 1F:
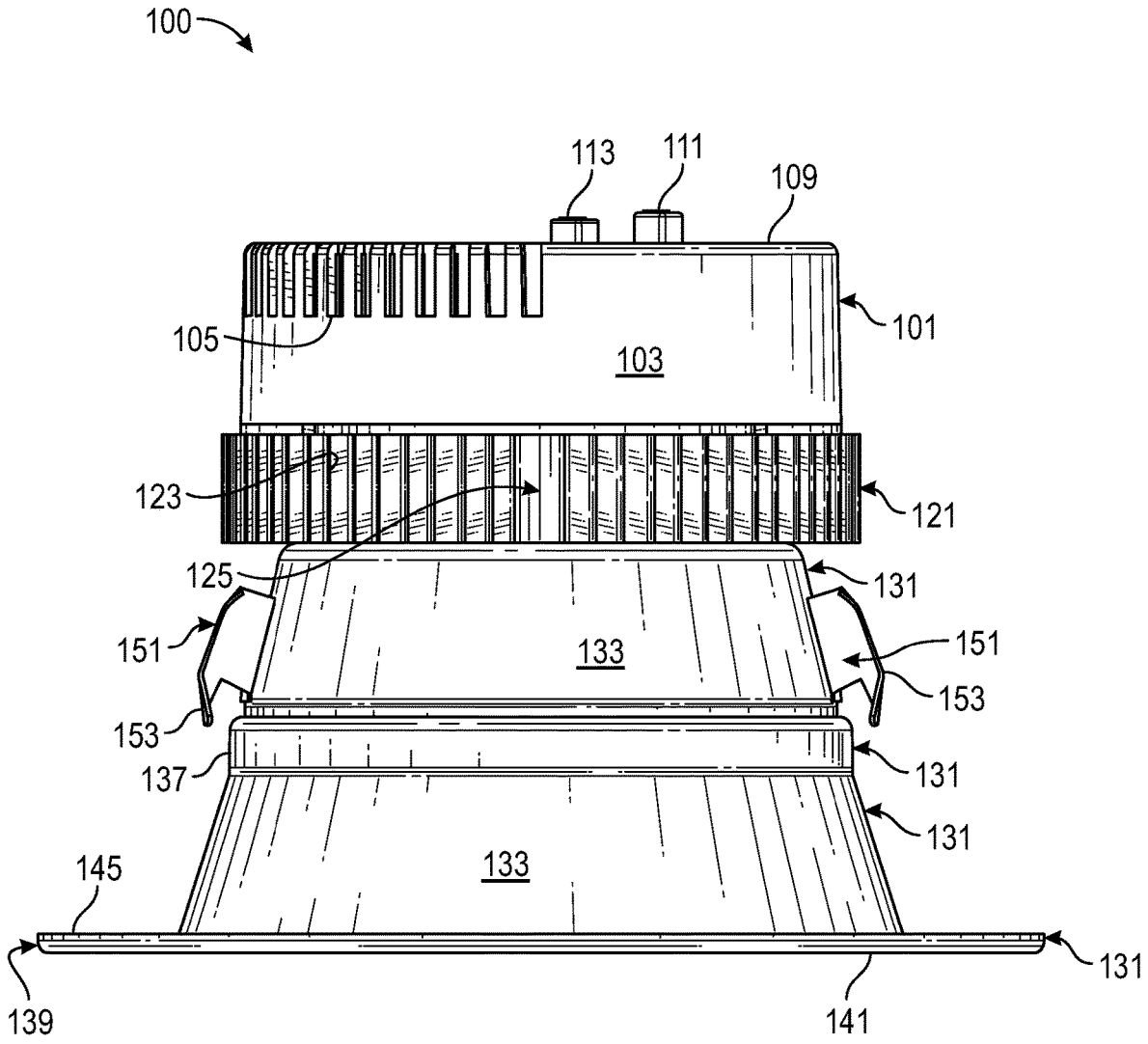
FIG. 1F depicts a front view of the light fixture of FIG. 1A (in an assembled configuration).
Figure 1G:
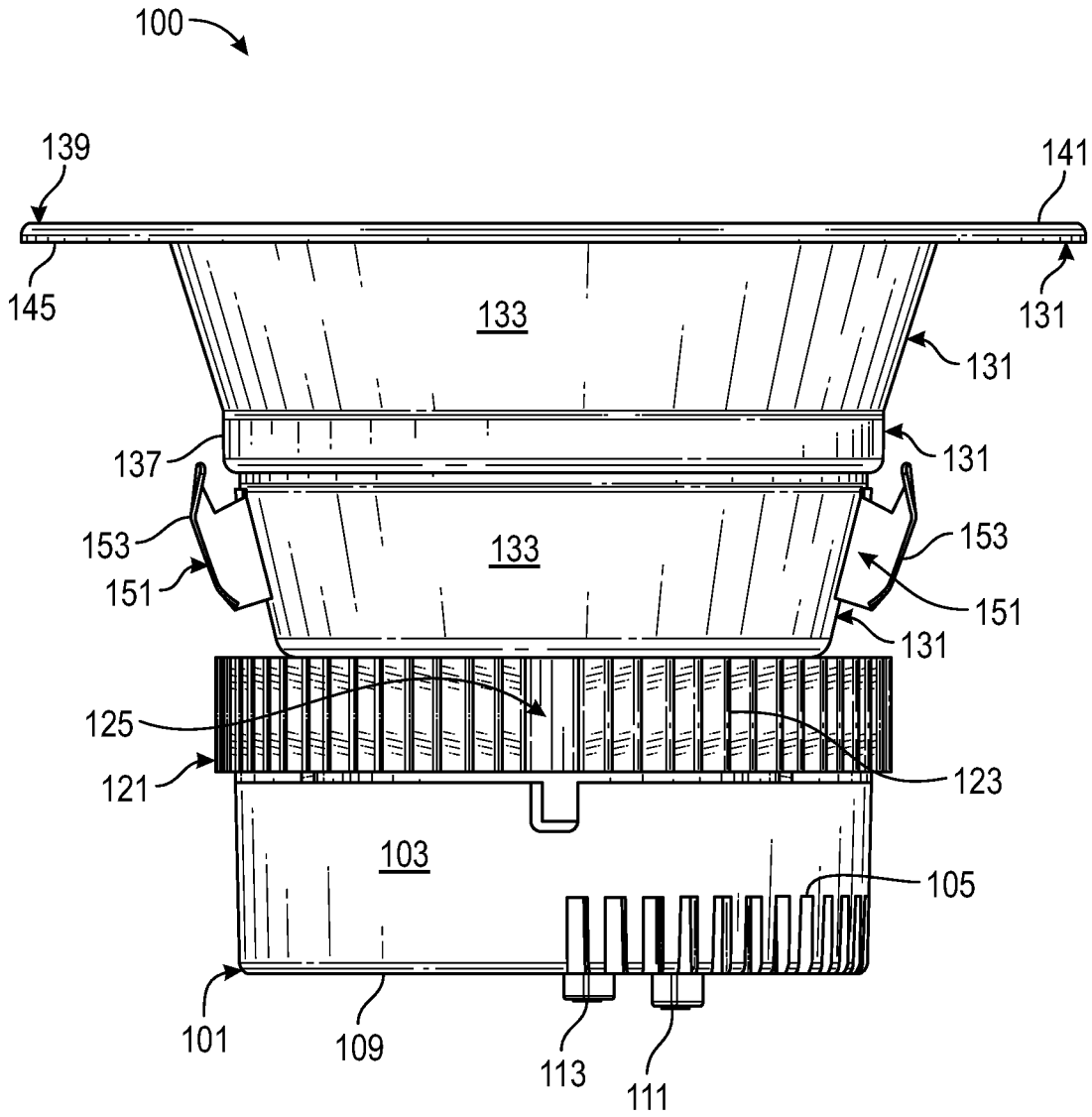
FIG. 1G depicts a rear (back) view of the light fixture of FIG. 1A (in an assembled configuration).
Figure 1H:
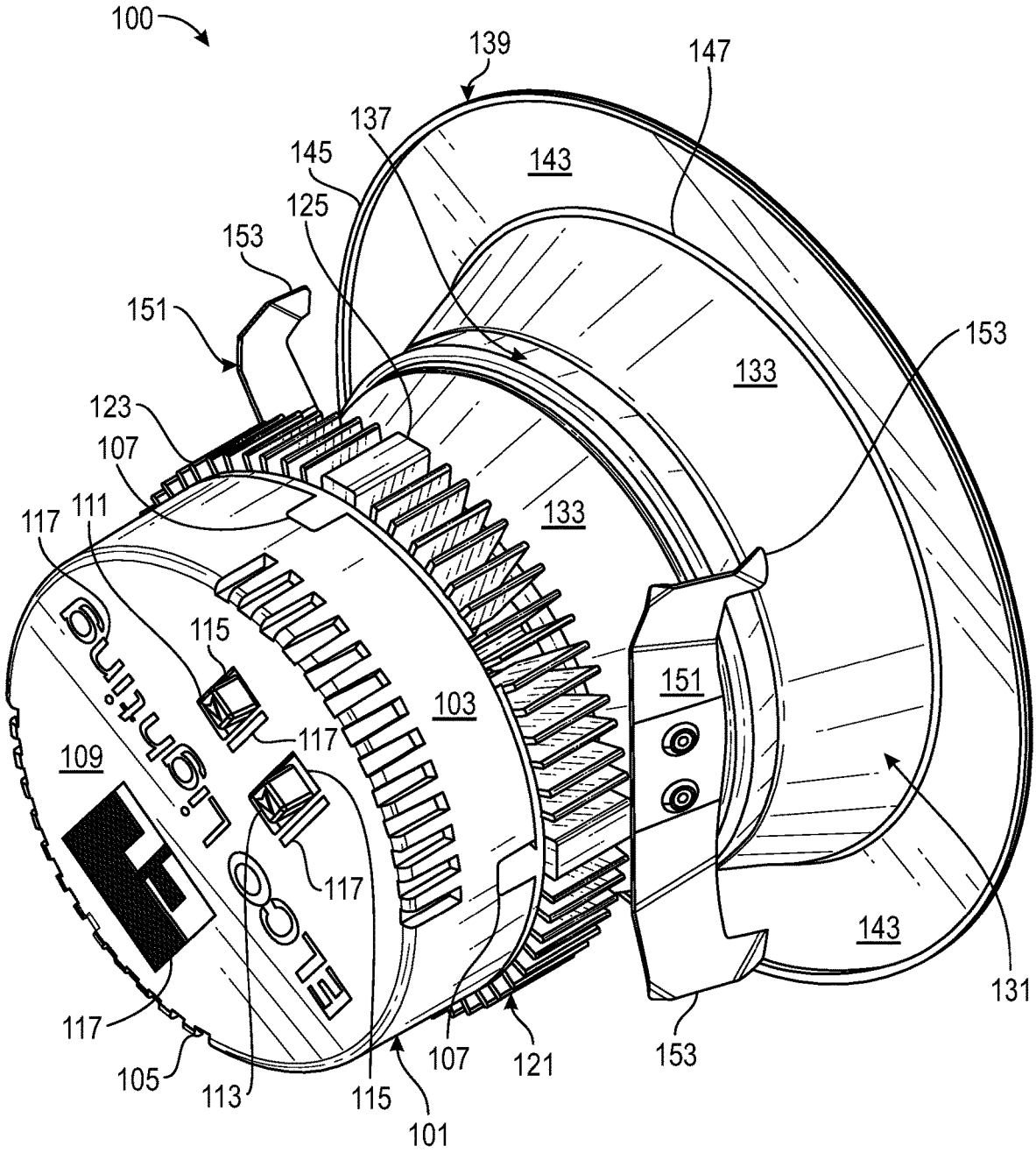
FIG. 1H depicts a top perspective view of the light fixture of FIG. 1A (in an assembled configuration).
Figure 2:
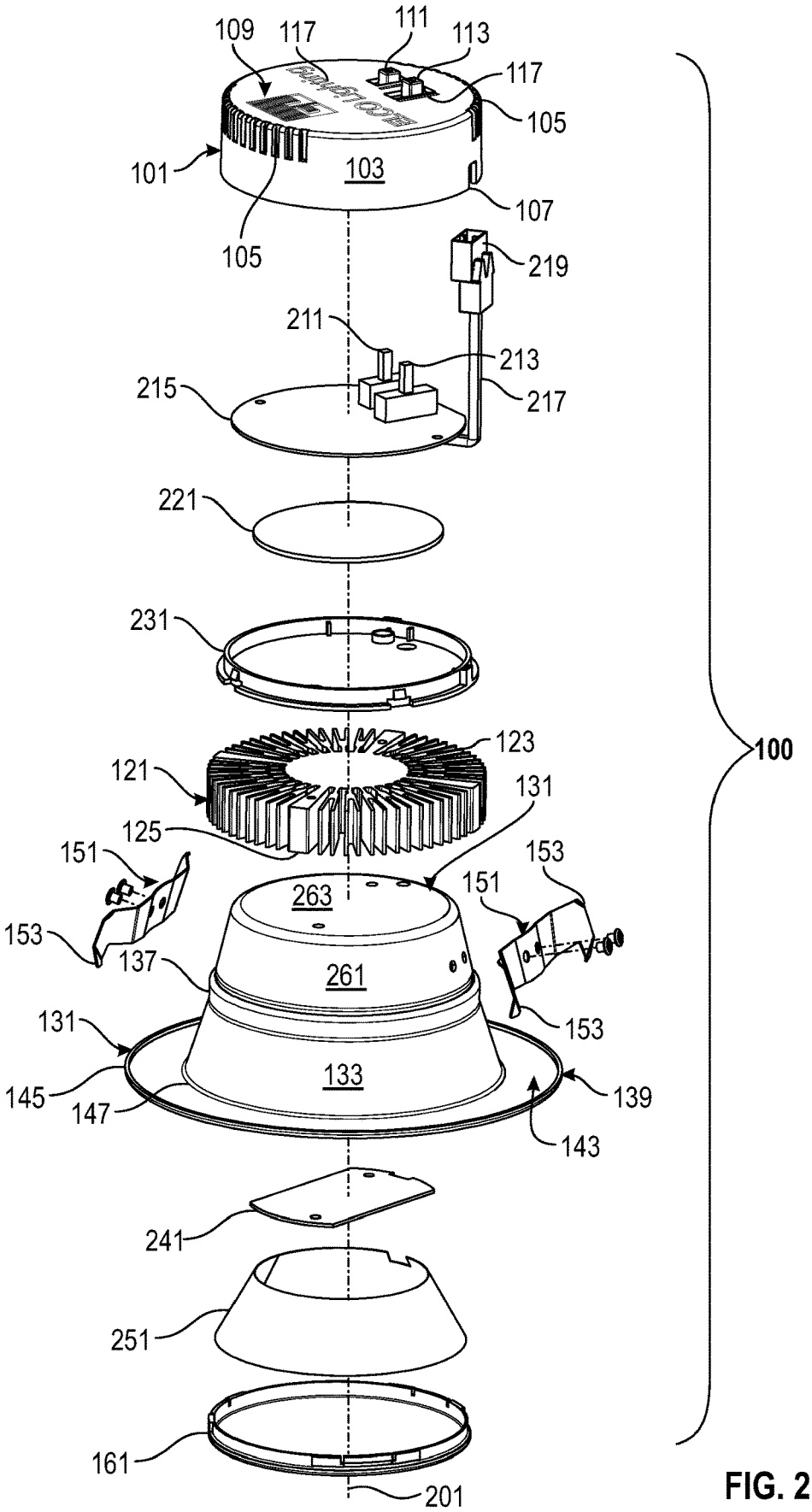
FIG. 2 depicts a top perspective exploded view of the light fixture of FIG. 1A.
Figure 3:
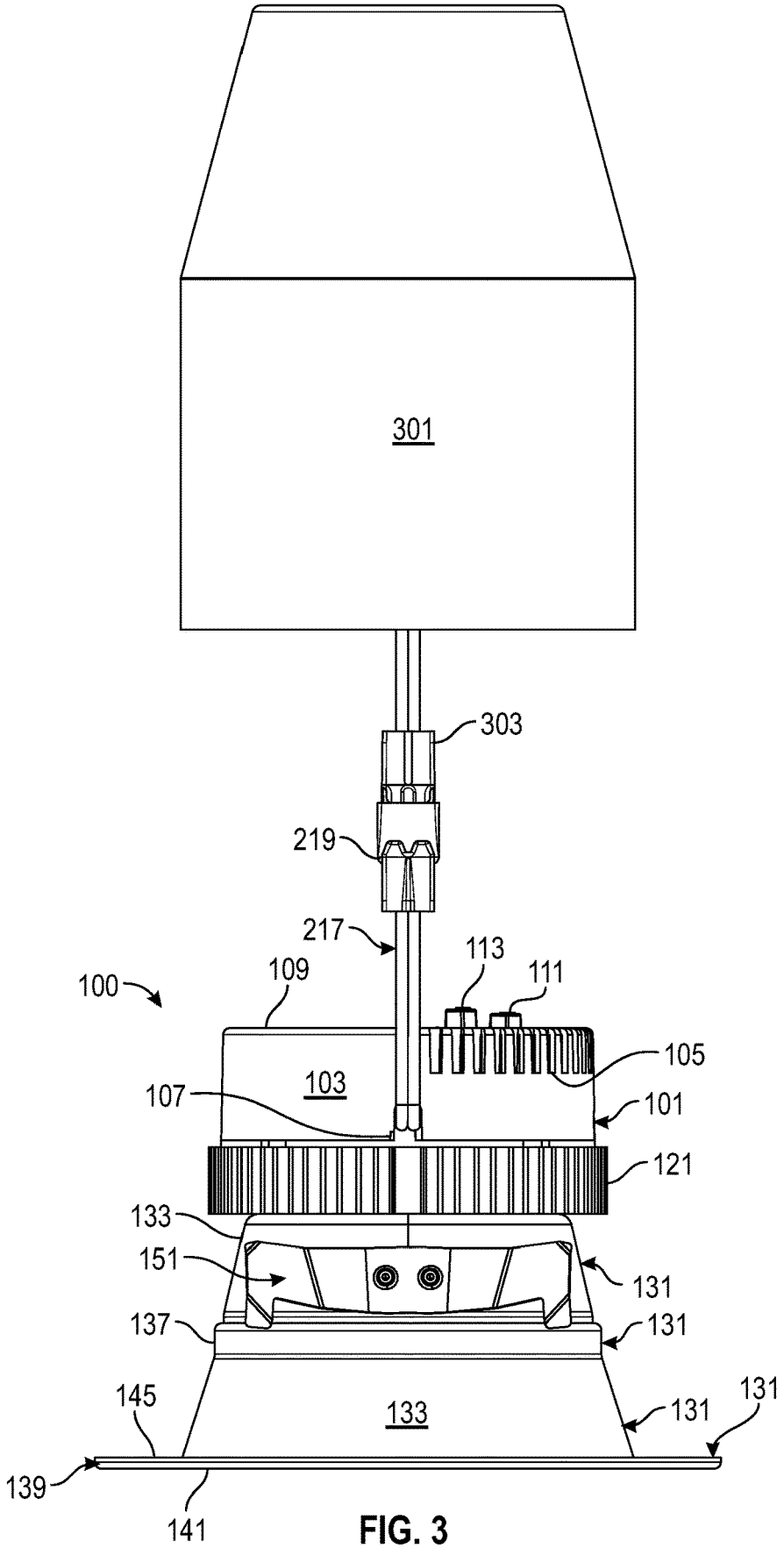
FIG. 3 depicts the light fixture of FIG. 1A connected and ready for installation into a can/housing, from a side view.
Figure 5:
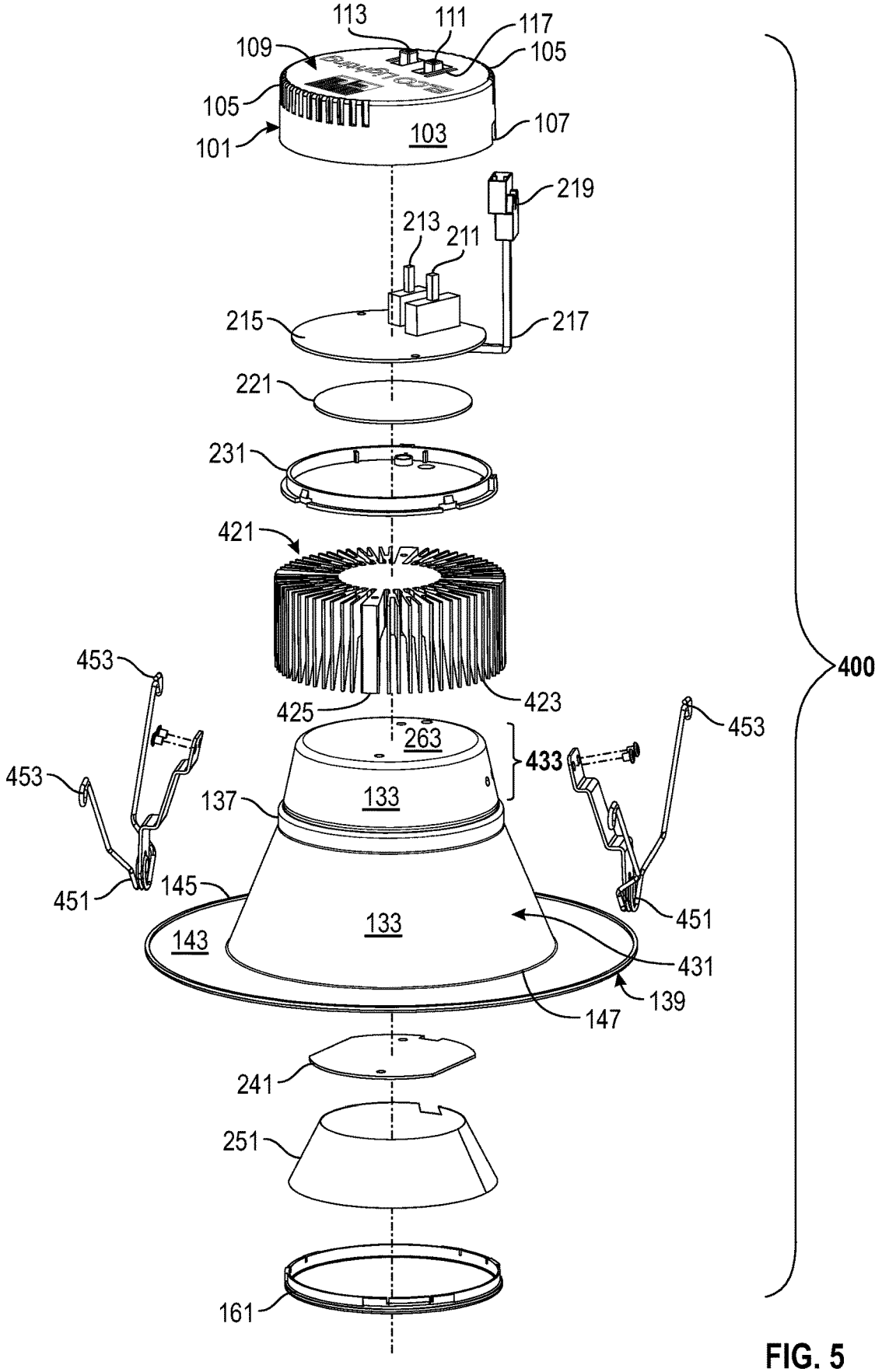
FIG. 5 depicts a top perspective exploded view of the light fixture of FIG. 4A.
Figure 6:
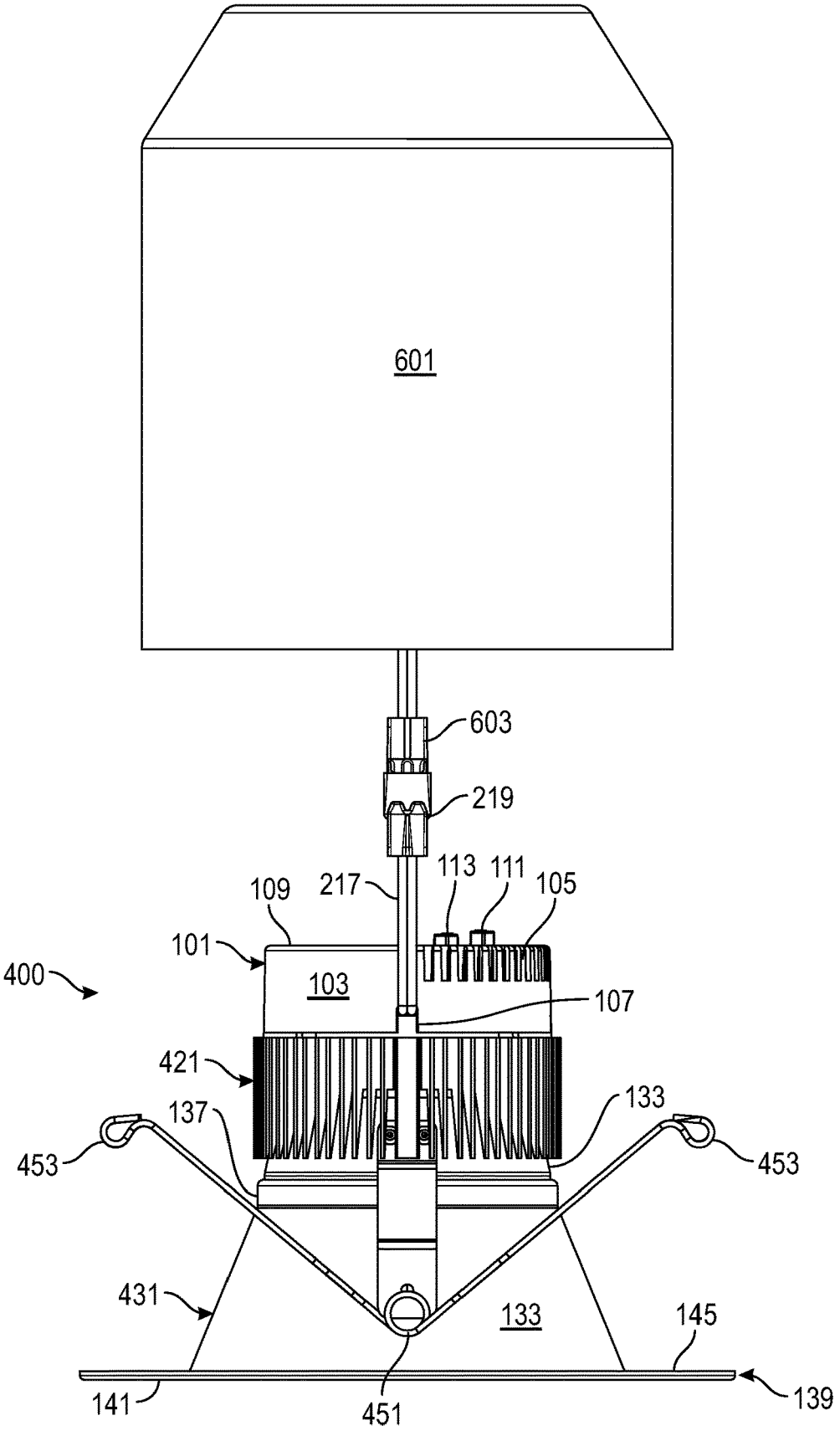
FIG. 6 depicts the light fixture of FIG. 4A connected and ready for installation into a can/housing, from a side view.

Note, the 1XX series reference numerals may be shown in at least one of the FIG. 1A through FIG. 1H drawing figures; the 2XX series reference numerals may be shown in FIG. 2 (and in FIG. 5); the 3XX series reference numerals may be shown in FIG. 3; the 4XX reference numerals may be shown in at least one of FIG. 4A through FIG. 4H; and the 6XX series reference numerals may be shown in FIG. 6.

FIG. 1A through FIG. 3 may depict light fixture 100; and FIG. 4A through FIG. 6 may depict light fixture 400. In some embodiments, light fixture 100 may differ from light fixture 400 in that: light fixture 100 may be smaller than light fixture 400; light fixture 400 may be larger than light fixture 100; light fixture 100 may have a smaller diameter flange 139 than light fixture 400; light fixture 400 may have a larger diameter flange 139 than light fixture 100; light fixture 100 may have a smaller total (overall) height than light fixture 400; light fixture 400 may have a larger total (overall) height than light fixture 100; light fixture 100 may into different sized cans/housings than light fixture 400; heat-sink 421 may taller than heat-sink 121; fins 423/425 of heat-sink 421 may be of different shapes than fins 123/125 of heat-sink 121; trim/casing 431 may be taller than trim/casing 131 (trim-casing-member); light fixture 100 may have different voltage and/or wattage configurations than light fixture 400; light fixture 100 may have different lumens output than light fixture 400; light fixture 100 may have different light color-temperature output than light fixture 400; and/or an upper-portion 433 of trim/casing 431 of light fixture 400 may be received into (inside) of heat-sink 421 of light fixture 400, whereas, in light fixture 100 its trim/casing 131 is not received into its heat-sink 121. However, light fixture 100 and light fixture 400 may otherwise share similar parts, components, purposes, use, functionality, and/or the like.

FIG. 1A depicts a bottom perspective view of a light fixture 100 (in an assembled configuration). FIG. 1B depicts a bottom view of light fixture 100 (in an assembled configuration). In some embodiments, light fixture 100 may comprise: a driver-box 101, a heat-sink 121, a trim-casing 131, a pressure-clip 151, a lens 161, a reflector 251, a LED chip/board 241 (light-emitting-diode-circuit), a driver-cap 231, a driver-PCB 221 (driver-printed-circuit-board), a lumen-switch 211, a color-temperature-switch 213, and a power connector 219.

Continuing discussing FIG. 1A and FIG. 1B, in some embodiments, when light fixture 100 may be in its assembled configuration the following components/parts may be at least partially visible from an exterior of light fixture 100: driver-box 101, heat-sink 121, trim-casing 131, pressure-clips 151, lens 161, wiring/cabling 217, and power connector 219. Note, wiring/cabling 217 and power connector 219 were omitted from FIG. 1A through FIG. 1H but are shown in FIG. 2. With respect to orientation of light fixture 100, a top of light fixture 100 is at top 109 and a bottom of light fixture 100 is at flange 139. In some embodiments, driver-box 101 may be located in a top portion or an upper portion of light fixture 100. In some embodiments, trim/casing 131 may be located from a middle region to a bottom portion or lower portion of light fixture 100. In some embodiments, heat-sink 121 may be disposed between driver-box 101 and trim/casing 131. In some embodiments, lens 161 may be mounted inside of trim/casing 131 and at least partially visible from a bottom of light fixture 100 (see e.g., FIG. 1A and FIG. 1B).

Continuing discussing FIG. 1A, in some embodiments, driver-box 101 may be a substantially hollow cylindrical short member, with a mostly closed top 109, (curving) side-wall 103, and an open bottom. In some embodiments, side-wall 103 may be the side-walls of driver-box 101. In some embodiments, side-wall 103 may be curved, as in a curve of a circle or cylinder side wall. In some embodiments, at least some transverse width cross-sections through driver-box 101 may yield a shape that is substantially circular in shape. In some embodiments, top 109 may be the top (top surface) of driver-box 101. In some embodiments, a hollow interior of driver-box 101 may be configured to receive and/or house at least portions of: lumen-switch 211, color-temperature-switch 213, switch chassis 215, wiring/cabling 217, driver-PCB 221, and driver-cap 231, portions thereof, combinations thereof, and/or the like (see e.g., FIG. 2). In some embodiments, side-wall 103 may be disposed between top 109 and the bottom of driver-box 101. In some embodiments, side-wall 103 may connect the bottom of driver-box 101 to top 109. In some embodiments, located on side-wall 103 may be at least one fin 105. In some embodiments, located on side-wall 103 may be a plurality of fins 105. In some embodiments, fin(s) 105 of side-wall 103 may be configured to emit/transfer heat away from driver-box 101 an into the ambient surrounding air (i.e., the air that may surround light fixture 100). In some embodiments, fin(s) 105 of side-wall 103 may be located on side-wall 103 from an upper one-third of driver-box 101 to an upper one-half of driver-box 101, with respect to a height of driver-box 101 (see e.g., FIG. 1A, FIG. 1D, FIG. 1E, FIG. 1F, FIG. 1G, and FIG. 1H). In some embodiments, lower portions and/or bottom regions of driver-box 101, with respect to a height of driver-box 101 may devoid of fin(s) 105 on side-wall 103 (see e.g., FIG. 1A, FIG. 1D, FIG. 1E, FIG. 1F, FIG. 1G, and FIG. 1H). In some embodiments, fin(s) 105 of side-wall 103 may have tops on and/or visible from top 109, partially around an outside edge of top 109 (see e.g., FIG. 1C).

Continuing discussing FIG. 1A, in some embodiments, heat-sink 121 may be a mostly cylindrical member comprising of a plurality of fins 123/125 that run around the outside side periphery of heat-sink 121. In some embodiments, the plurality of fins 123/125 may be oriented in a radial fashion with respect to a common longitudinal center 201 of light fixture 100. In some embodiments, each fin 123 may be a substantially (mostly) planar member. In some embodiments, each fin 123 may be run up and down (parallel to common longitudinal center 201). In some embodiments, heat-sink 121 may have two different types of fins, fin-thin 123 and fin-thick 125. In some embodiments, fin-thin 123 may be thinner than fin-thick 125. In some embodiments, fin-thick 125 may be thicker than fin-thin 123. In some embodiments, there may be four (4) fins-thick 125. In some embodiments, fins-thin 123 may be more numerous than fins-thick 125.

Continuing discussing FIG. 1A, in some embodiments, trim/casing 131 may be a mostly hollow conical member (i.e., mostly a hollow conical frustum member) that terminates into a flange 139 where trim/casing 131 is at its widest diameter at the bottom of light fixture 100. In some embodiments, trim/casing 131 may be divided into its mostly conical member and its flange 139, with the mostly conical member occupying the top/upper regions of trim/casing 131 and flange 139 occupying the very bottom of trim/casing 131. In some embodiments, side-walls of the conical member of trim/casing 131 may be a conical-exterior 133 and a conical-interior 135. In some embodiments, conical-exterior 133 and conical-interior 135 may be opposite sides/surfaces of the mostly conical member of trim/casing 131. In some embodiments, at least some of conical-interior 135 may be visible from bottom views of light fixture 101. In some embodiments, at least some light emitted from light fixture 100 may shine upon portions of conical-interior 135.

Continuing discussing FIG. 1A, in some embodiments, the mostly conical member of trim/casing 131 may be interrupted by cylindrical-region 137, which may be region of that is more cylindrical than conical. In some embodiments, above and below cylindrical-region 137 may regions of trim/casing 131 that are mostly conical in shape.

Continuing discussing FIG. 1A, in some embodiments, flange 139 may be located at a base of the mostly conical member of trim/casing 131, at the bottom of light fixture 100. In some embodiments, flange 139 may be a mostly planar, flat, disk/disc like, annular member. In some embodiments, flange 139 may comprise flange-bottom 141. In some embodiments, when light fixture may be installed in a ceiling or wall, flange-bottom 141 may be visible overlapping drywall (or the like). In some embodiments, when light fixture may be installed in a ceiling or wall, flange 139 may trim out (cover) a hole cut into the drywall (or the like), wherein this hole may be for receiving can/housing 301 and light fixture 100. In some embodiments, flange-bottom 141 may be visible from bottom views of light fixture 100. In some embodiments, flange-bottom 141 may be a mostly planar, flat, disk/disc like, annular member.

Continuing discussing FIG. 1A, in some embodiments, attached to conical-exterior 133 may be one or more pressure-clip(s) 151. In some embodiments, attached to conical-exterior 133 may be two oppositely disposed pressure-clips 151. In some embodiments, attached to an exterior of trim/casing 131 may be one or more pressure-clip(s) 151. In some embodiments, attached to an exterior of trim/casing 131 may be two oppositely disposed pressure-clips 151. (In some embodiments, attachment of a pressure-clip 151 to trim/casing 131 may be by one or more mechanical fasteners, welding, adhesive, portions thereof, combinations thereof, and/or the like.) In some embodiments, a pressure-clip 151 may comprise two opposing wings 155 that extend and/or protrude away from a center of a pressure-clip 151. In some embodiments, the wings 155 of a given pressure-clip 151 may be configured to removably frictionally grip/engage an interior surface of a can/housing 301, wherein can/housing 301 (see FIG. 3 for can/housing 301) may be configured to removably receive a given light fixture 100.

Continuing discussing FIG. 1A and FIG. 1B, in some embodiments, lens 161 may be configured to permit passage of light. In some embodiments, lens 161 may be substantially optically clear, transparent, translucent, portions thereof, combinations thereof, and/or the like. In some embodiments, lens 161 may be substantially optically clear, transparent, translucent, portions thereof, combinations thereof, and/or the like, with respect to a predetermined range of wavelengths of light, of lumens, of light color-temperatures, portions thereof, combinations thereof, and/or the like. In some embodiments, lens 161 may be curved for a purpose of focusing light passing through and out of lens 161. In some embodiments, lens 161 may be mounted inside of trim/casing 131.

FIG. 1C depicts a top view of light fixture 100 (in an assembled configuration). In some embodiments, fins 105 of driver-box 101 may be grouped into two opposing groups of fins 105, separated by two opposing regions of no fins 105. In some embodiments, top 109 may comprise one or more of: lumen-switch-cover 111, color-temperature-switch-cover 113, switch-aperture 115, indicia 117, portions thereof, combinations thereof, and/or the like. In some embodiments, driver-box 101 may comprise two distinct, different, opposing sets of fins 105 configured for heat dissipation. In some embodiments, the two distinct, different, opposing sets of fins 105 may be equally spaced apart from each other by regions of driver-box 101 without fins 105. In some embodiments, each fin 105, selected from the two distinct, different, opposing sets of fins 105 may runs from a side-wall 103 of driver-box 101 to a top 109 of driver-box 101. However, in some embodiments, a bottom portion of driver-box 101 side-wall 103 may have no fins 105.

Continuing discussing FIG. 1C, in some embodiments, lumen-switch-cover 111 may be configured to be removably interacted with by fingers, thumb(s), and/or hand(s) of a user to select lumen output of light fixture 100. In some embodiments, color-temperature-switch-cover 113 may be configured to be removably interacted with by fingers, thumb(s), and/or hand(s) of a user to select light color-temperature output of light fixture 100. In some embodiments, lumen-switch-cover 111 and/or color-temperature-switch-cover 113 may be a membrane cover. In some embodiments, the membrane cover may be water resistant or water proof.

Continuing discussing FIG. 1C, in some embodiments, top 109 may have one or more holes, for example, switch-aperture(s) 115. In some embodiments, switch-aperture 115 may be a hole in top 109. In some embodiments, switch-aperture 115 may be configured to pass and/or receive at least a portion of: lumen-switch-cover 111, color-temperature-switch-cover 113, lumen-switch 211, color-temperature-switch 213, portions thereof, combinations thereof, and/or the like. In some embodiments, there may be one switch-aperture 115 for lumen switching and one switch-aperture 115 for color-temperature switching. In some embodiments, the two switch-apertures 115 may be grouped together side by side.

Continuing discussing FIG. 1C, in some embodiments, top 109 may comprise various indicia 117. In some embodiments, indicia 117 may be one or more of: a logo, a company name, a trademark, a brand, a trade name, a slogan, a catch phrase, a model number, a serial number, a range of selectable lumens, a range of selectable color-temperatures, a registration number, certification information, testing information, standards information, rating information, specification information, a lot number, inspection information, a patent number, patent pending status, a website, a phone number, a mailing address, portions thereof, combinations thereof, and/or the like. In some embodiments, adjacent and next to each switch-aperture 115 may be indicia of a range of selectable lumens and/or a range of selectable color-temperatures. In some embodiments, indicia 117 may be in the form of one or more of: a sticker, printed onto top 109, written onto top 109, painted onto top 109, drawn onto top 109, stenciled onto top 109, engraved onto top 109, carved into top 109, molded directly into top 109, portions thereof, combinations thereof, and/or the like.

Continuing discussing FIG. 1C, in some embodiments, flange 139 may comprise flange-top 143 and flange-lip 145. In some embodiments, flange-top 143 may be an opposing surface with respect to flange-bottom 141. In some embodiments, flange-bottom 141 and flange-top 143 may be different opposing sides/surfaces of flange 139. In some embodiments, when light fixture 100 may be installed in a ceiling and/or wall, flange-top 143 may not be visible. In some embodiments, flange-top 143 may be a mostly planar, flat, disk/disc like, annular member. In some embodiments, towards an outside edge of flange 139 may be flange-lip 145. In some embodiments, flange-lip 145 may be an annular fixed ridge the extends/protrudes orthogonally away from flange-top 143 (towards top 109 and/or towards top 263). In some embodiments, flange-conical-transition 147 may indicate where flange 139 begins and the mostly conical member of trim/casing 131 ends. In some embodiments, flange-conical-transition 147 may be relatively smooth. In some embodiments, flange-conical-transition 147 may be devoid of a raised wall/ridge. In some embodiments, the outside diameter of flange 139 may be five and one-half (5½) inches. In some embodiments, an inside diameter of flange 139 may be four (4) inches. In other embodiments, one or more of these diameter dimensions may be different, but fixed and predetermined.

FIG. 1D depicts a right-side view of light fixture 100 (in an assembled configuration). FIG. 1E depicts a left-side view of light fixture 100 (in an assembled configuration). FIG. 1F depicts a front view of light fixture 100 (in an assembled configuration). FIG. 1G depicts a rear (back) view of light fixture 100 (in an assembled configuration). In some embodiments, a total (overall) height of light fixture 100 may be four (4) inches (not including wiring/cabling). In other embodiments, the total (overall) height of light fixture 100 may be a different dimension, but fixed and predetermined.

In some embodiments, at least portions of lumen-switch-cover 111 and/or color-temperature-switch-cover 113 may extend/protrude orthogonally away from top 109 and above top 109. See e.g., FIG. 1D through FIG. 1G.

In some embodiments, side-wall 103 may comprise at least one notch 107. In some embodiments, side-wall 103 may comprise at least two notches 107. In some embodiments, notch 107 may be a notch, a cutout, a hole, an aperture, portions thereof, combinations thereof, and/or the like, in side-wall 103. In some embodiments, notch 107 may be configured and sized for the passage of at least some portions of wiring and/or cabling, such as, but not limited to, wiring/cabling 217. In some embodiments, notch 107 may be located closer to the bottom of driver-box 101 than to top 109. In some embodiments, notch 107 may be extend from the bottom of driver-box 101 towards top 109, but notch 107 may not touch top 109. In some embodiments, notch 107 may be on a bottom one-third to a bottom one-half of driver-box 101. See e.g., FIG. 1E and FIG. 1G.

In some embodiments, a greatest diameter of light fixture 100 may be an outside diameter of flange 139. In some embodiments, an outside diameter of heat-sink 121 may be larger than an outside diameter of driver-box 101. In some embodiments, the outside diameter of heat-sink 121 may be about the same as an outside diameter of cylindrical-region 137 of the mostly conical member of trim/casing 131. See e.g., FIG. 1D through FIG. 1G.

In some embodiments, cylindrical-region 137 may be located about one (1) inch from flange 139/flange-bottom 141. See e.g., FIG. 1D through FIG. 1G.

In some embodiments, the fins 123/125 of heat-sink 121 may run from a bottom of heat-sink 121 to a top of heat-sink 121. See e.g., FIG. 1D through FIG. 1G.

FIG. 1H depicts a top perspective view of light fixture 100 (in an assembled configuration).

FIG. 2 depicts a top perspective exploded view of light fixture 100. FIG. 2 may show common longitudinal center 201 of light fixture 100. In some embodiments, common longitudinal center 201 is also an imaginary central axis of light fixture 100 wherein the main component parts are exploded along this imaginary line in FIG. 2.

Continuing discussing FIG. 2, in some embodiments, light fixture 100 may be configured for mounting within a given can/housing 301 (see e.g., FIG. 3). In some embodiments, light fixture 100 may comprise a driver assembly, heat-sink 121, and a trim-casing assembly.

Continuing discussing FIG. 2, in some embodiments, the driver assembly may comprise driver-PCB 221, lumen-switch 211, color-temperature-switch 213, and driver-box 101. In some embodiments, driver-PCB 221, lumen-switch 211, and color-temperature-switch 213 may be at least mostly housed within driver-box 101. In some embodiments, driver-PCB 221 may be configured to provide electrical power and/or to control LED-chip-board 241. In some embodiments, lumen-switch 211 may be configured to change a lumen output of LED-chip/board 241. In some embodiments, color-temperature-switch 213 may be configured to change a light color-temperature output of LED-chip/board 241.

Continuing discussing FIG. 2, in some embodiments, the driver assembly may further comprise lumen-switch-cover 111 and color-temperature-switch-cover 113. In some embodiments, lumen-switch-cover 111 may cover over the lumen-switch 211. In some embodiments, lumen-switch-cover 111 may be in physical communication with the lumen-switch 211. In some embodiments, color-temperature-switch-cover 113 may cover over color-temperature-switch 213. In some embodiments, color-temperature-switch-cover 113 may be in physical communication with the color-temperature-switch 213. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of driver-box 101. In some embodiments, at least a portion of the lumen-switch-cover 111 and at least a portion of the color-temperature-switch-cover 113 may be both configured to be engaged (i.e., switched to different positions) by a finger, a thumb, and/or a hand of a user.

Continuing discussing FIG. 2, in some embodiments, the driver assembly may further comprise one or more of: lumen-switch-cover 111, color-temperature-switch-cover 113, switch chassis 215, wiring/cabling 217, power connector 219, driver-cap 231, portions thereof, combinations thereof, and/or the like.

Continuing discussing FIG. 2, in some embodiments, the trim-casing assembly may comprise LED-chip/board 241, reflector 251, lens 161, a can-attachment-means, and trim/casing 131. In some embodiments, LED-chip/board 241, reflector 251, and lens 161 may be housed within trim/casing 131. In some embodiments, LED-chip/board 241 may be configured to output light of a predetermined luminosity and of a predetermined light color-temperature. In some embodiments, the can-attachment-means may be mounted to an exterior of trim/casing 131. In some embodiments, the can-attachment-means may be configured to removably mount light fixture 100 within can/housing 301. In some embodiments, the can-attachment-means may be one or more of: pressure-clip 151, torsion-spring 451, combinations thereof, and/or the like.

Continuing discussing FIG. 2, in some embodiments, lumen-switch 211, color-temperature-switch 213, and LED-chip/board 241 may all be operatively connected to driver-PCB 221. In some embodiments, heat-sink 121 may be disposed below the driver assembly and entirely above the trim-casing assembly. In some embodiments, heat-sink 121 may be disposed entirely below driver-cap 231 and entirely above trim/casing 131.

Continuing discussing FIG. 2, in some embodiments, when light fixture 100 may be assembled, switch chassis 215, driver-PCB 221, and driver-cap 231 may be located at least mostly to entirely within the hollow interior of driver-box 101. In some embodiments, when light fixture 100 may be assembled, lumen-switch 211 and color-temperature-switch 213 may be located at least partially within the hollow interior of driver-box 101. In some embodiments, switch chassis 215 may be a structural member wherein lumen-switch 211 and/or color-temperature-switch 213 are attached thereto. In some embodiments, switch chassis 215 may be a mostly circular disc like member. In some embodiments, switch chassis 215 may comprise circuitry, wiring, cabling, wiring/cabling 217, switches, lumen-switch 211, color-temperature-switch 213, portions thereof, combinations thereof, and/or the like. In some embodiments, driver-PCB 221 may be a printed circuit board. In some embodiments, driver-PCB 221 may comprise one or more circuits. In some embodiments, driver-PCB 221 may be configured for lighting/LED driver, control, management, and/or regulation functions. In some embodiments, driver-PCB 221 may have a power factor greater than 0.9 and a start time of less than 0.75 seconds. In some embodiments, driver-PCB 221 may be electrically coupled to: lumen-switch 211, color-temperature-switch 213, wiring/cabling 217, power connector 219, LED-chip/board 241, wiring, cabling, portions thereof, combinations thereof, and/or the like. In some embodiments, driver-cap 231 may cover over the bottom of driver-box 101. In some embodiments, driver-PCB 221 may be referred to as a "driver-printed-circuit-board." In some embodiments, driver-cap 231 may be removably attached to the bottom of driver-box 101 and/or to a top of heat-sink 121. In some embodiments, driver-cap 231 may be a mostly planarly flat plate disc like member (with hole(s) for wire passage and/or for mechanical fasteners).

Continuing discussing FIG. 2, in some embodiments, light fixture 100 may comprise wiring/cabling 217. In some embodiments, wiring/cabling 217 may be configured for electrical power transmission. In some embodiments, wiring/cabling 217 may terminate in power connector 219. In some embodiments, wiring/cabling 217 may also terminate at lumen-switch 211, color-temperature-switch 213, switch chassis 215, portions thereof, combinations thereof, and/or the like. In some embodiments, power connector 219 may be configured to be removably attached to a complimentary power connector (e.g., power source 303), so that light fixture 100 may receive electrical power for operation. In some embodiments, light fixture 100 may comprise other wiring and/or cabling in addition to wiring/cabling 217.

Continuing discussing FIG. 2, in some embodiments, light fixture 100 may be configured for operation at predetermined voltage and/or wattage. For example, and without limiting the scope of the present invention, in some embodiments, light fixture 100 may be configured for operation at 120 volts, 9.5 watts, 13.5 watts, and/or 18 watts. In other embodiments, light fixture 100 may be configured for operating at other voltages and/or wattages.

Continuing discussing FIG. 2, in some embodiments, lumen-switch-cover 111 may cover over a below located lumen-switch 211. In some embodiments, lumen-switch-cover 111 may be in physical communication with below located lumen-switch 211. In some embodiments, color-temperature-switch-cover 113 may cover over a below located color-temperature-switch 213. In some embodiments, color-temperature-switch-cover 113 may be in physical communication with below color-temperature-switch 213.

Continuing discussing FIG. 2, in some embodiments, lumen-switch 211 may be a switch configured to change the luminosity of emitted light from LED-chip/board 241, within a predetermined range of luminosity (e.g., in lumens). In some embodiments, lumen-switch 211 may be configured to select lumens output from 1000 to 2000 lumens. In some embodiments, lumen-switch 211 may be configured to select lumens output at 1000 lumens, 1250 lumens, 1500 lumens, 1750 lumens, and/or 2000 lumens. In some embodiments, lumen-switch 211 may be configured to select lumens output from 500 to 3000 lumens or some whole number subset range thereof. In other embodiments, other predetermined lumens may be selected (selectable) by lumen-switch 211.

Continuing discussing FIG. 2, in some embodiments, color-temperature-switch 213 may be a switch configured to change the emitted light color-temperature from LED-chip/board 241, within a predetermined range of light color-temperatures (e.g., in Kelvin). In some embodiments, color-temperature-switch 213 may be configured to select light color-temperatures from 2700 Kelvin to 5000 Kelvin. In some embodiments, color-temperature-switch 213 may be configured to select light color-temperatures at 2700 Kelvin, 3000 Kelvin, 3500 Kelvin, 4000 Kelvin, and/or 5000 Kelvin. In other embodiments, other predetermined light color-temperatures may be selected (selectable) by color-temperature-switch 213.

Continuing discussing FIG. 2, in some embodiments, heat-sink 121 may be configured to receive heat from electronic components of light fixture 100 and to then dissipate this received heat into the surrounding ambient air. In some embodiments, the electronic components of light fixture 100 that may generate and/or emit heat may be one or more of: LED-chip/board 241, driver-PCB 221, lumen-switch 211, color-temperature-switch 213, wiring/cabling 217, power connector 219, portions thereof, combinations thereof, and/or the like. In some embodiments, each fin 123/125 may be shaped substantially as a rectangular prism. In some embodiments, a center of heat-sink 121 may be devoid of fins 123/125. In some embodiments, a center of heat-sink 121 may be devoid of material, i.e., the center may be void space (however wiring [not shown] may pass through this otherwise void space). In some embodiments, the four fins-thick 125 may be equally spaced around heat-sink 121 with respect to the common longitudinal center 201 of light fixture 100; with a plurality of fins-thin 123 disposed between each fin-thick 125, such that there are four distinct regions (quadrants) of fins-thin 123 (see e.g., FIG. 2). In some embodiments, heat-sink 121 may comprise four fins-thick 125 and four groups of fins-thin 123. In some embodiments, each group of fins-thin 123 may be disposed two different of fins-thick 125. In some embodiments, all of fins-thick 125 and all of fins-thin 123 may be arranged radially around a common longitudinal center line 201 of light fixture 100. In some embodiments, all of fins-thick 125 and all of fins-thin 123 may have a same (exterior) height from a bottom of heat-sink 121 to a top of heat-sink 121. In some embodiments, an exterior of heat-sink 121 from a bottom of heat-sink 121 to a top of heat-sink 121 may be substantially cylindrical in shape with a same outer diameter up and down that exterior. In some embodiments, the exterior of heat-sink 121 may be devoid of any steps. In some embodiments, the exterior of heat-sink 121 may be devoid of threading for attachment to trim/casing 131. In some embodiments, a fin-thick 125 may have a hole, wherein such a hole may be configured for receiving a screw, post, bolt, pin, mechanical fastener, portions thereof, combinations thereof, and/or the like, wherein this hole runs in a vertical direction, parallel to the common longitudinal center 201 of light fixture 100 (see e.g., FIG. 2).

Continuing discussing FIG. 2, in some embodiments, trim/casing 131 may comprise a substantially conical frustum member that has a mostly closed top 263 and an open base. In some embodiments, the substantially conical frustum member may be interrupted by cylindrical-region 137 that is more cylindrical than conical, wherein a portion above the cylindrical-region of trim/casing 131 is conical and a portion below cylindrical-region 137 of trim/casing 131 is conical. In some embodiments, lens 161 may be housed within cylindrical-region 137 of trim/casing 131. In some embodiments, reflector 251 and LED-chip/board 241 may be both housed above lens 161 in an upper-portion 261 of trim/casing 131 that is conical. In some embodiments, an outside diameter of cylindrical-region 137 of trim/casing 131 is about the same as an outside diameter of heat-sink 121. In some embodiments, trim/casing 131 does not extend into a bottom of heat-sink 121.

Continuing discussing FIG. 2, in some embodiments, cylindrical-region 137 may be sized and configured to removably receive lens 161 inside of cylindrical-region 137. In some embodiments, when light fixture 100 may be assembled, above lens 161 and inside of an upper-portion 261 of the mostly conical member of trim/casing 131 may be reflector 251 and LED-chip/board 241. In some embodiments, upper-portion 261 may be located between a top 263 of trim/casing 131 and cylindrical-region 137. In some embodiments, LED-chip/board 241 may be located on top of reflector 251 within upper-portion 261. In some embodiments, LED-chip/board 241 may be located closer to top 263 as compared to reflector 251. In some embodiments, top 263 may be mostly planarly flat and closed, aside from at least one hole. In some embodiments, hole(s) in top 263 may be configured for passage/receiving of portions of wires/cables; and/or for attaching trim/casing 131 to heat-sink 121 via mechanical fasteners, screws, bolts, pins, rods, and/or the like. In some embodiments, trim/casing 131 (e.g., top 263) does not extend into nor over portions of heat-sink 121. In some embodiments, top 263 may be constructed of a material that conducts heat well from top 263 and into heat-sink 121. In some embodiments, thermal-paste (or the like) may be located on a bottom of heat-sink 121 and top 263 to facilitate/promote heat transfer from top 263 and into heat-sink 121.

Continuing discussing FIG. 2, in some embodiments, LED-chip/board 241 may be a light source. In some embodiments, LED-chip/board 241 may be electrically powered. In some embodiments, when LED-chip/board 241 may be sufficiently electrically powered, LED-chip/board 241 may emit light. In some embodiments, when LED-chip/board 241 may be sufficiently electrically powered, LED-chip/board 241 may emit light down through reflector 251 and out of a bottom of light fixture 100. In some embodiments, LED-chip/board 241 may comprise one or more LEDs (light emitting diodes) and/or other types of light sources. In some embodiments, LED-chip/board 241 may comprise one or more LEDs (light emitting diodes) of different colors. In some embodiments, LED-chip/board 241 may comprise one or more printed circuit boards. In some embodiments, LED-chip/board 241 may comprise one or more circuits. In some embodiments, LED-chip/board 241 may be dimmable. In some embodiments, LED-chip/board 241 may be electrically coupled to driver-PCB 221, lumen-switch 211, color-temperature-switch 213, switch chassis 215, wiring/cabling 217, power connector 219, portions thereof, combinations thereof, and/or the like.

Continuing discussing FIG. 2, in some embodiments, LED-chip/board 241 may output lumens at a predetermined value. In some embodiments, LED-chip/board 241 may output lumens from a predetermined range of lumens. In some embodiments, LED-chip/board 241 may output lumens from 1000 to 2000 lumens. In some embodiments, LED-chip/board 241 may output lumens at 1000 lumens, 1250 lumens, 1500 lumens, 1750 lumens, and/or 2000 lumens. In some embodiments, LED-chip/board 241 may output lumens from 500 to 3000 lumens or some whole number subset range thereof. In other embodiments, other predetermined lumens may be output by LED-chip/board 241.

Continuing discussing FIG. 2, in some embodiments, LED-chip/board 241 may output light color-temperature at a predetermined value (e.g., in Kelvins). In some embodiments, LED-chip/board 241 may output light color-temperature from 2700 Kelvin to 5000 Kelvin. In some embodiments, LED-chip/board 241 may output light color-temperatures at 2700 Kelvin, 3000 Kelvin, 3500 Kelvin, 4000 Kelvin, and/or 5000 Kelvin. In other embodiments, other predetermined light color-temperatures may be output by LED-chip/board 241.

Continuing discussing FIG. 2, in some embodiments, reflector 251 may be a highly reflective conical frustum member. In some embodiments, at least an interior surface of reflector 251 that faces a bottom of light fixture 100 may have a substantially minor like reflective finish. In some embodiments, reflector 251 may be configured to reflect at least some light emitted by LED-chip/board 241. In some embodiments, reflector 251 may be configured to reflect at least some light emitted by LED-chip/board 241 downwards and out of a bottom of light fixture 100.

FIG. 3 depicts light fixture 100 connected and ready for installation into a can/housing 301, from a side view. In some embodiments, can/housing 301 might be mounted within a ceiling and/or a wall of building, such as, but not limited to, a residence and/or a commercial building. And thus, light fixture 100 may be mounted mostly (aside from flange 139) within the ceiling and/or the wall of that building. In some embodiments, light fixture 100 may be sized for a particular size and/or style of can/housing 301. In some embodiments, can/housing 301 may be sized for a particular size of light fixture 100. In some embodiments, can/housing 301 may be a four (4) inch (or other sized) ICA housing (such as for new construction, remodel, and/or with a particular fire hour rating). FIG. 3 shows that power connector 219 may be removably attached to power source 303, wherein power source 303 may be associated with can/housing 301. For example, and without limiting the scope of the present invention, power source 303 might be a 120-volt AC source (e.g., from a 15-amp or a 20-amp circuit) that may be feeding can/housing 301.

Figure 4A:
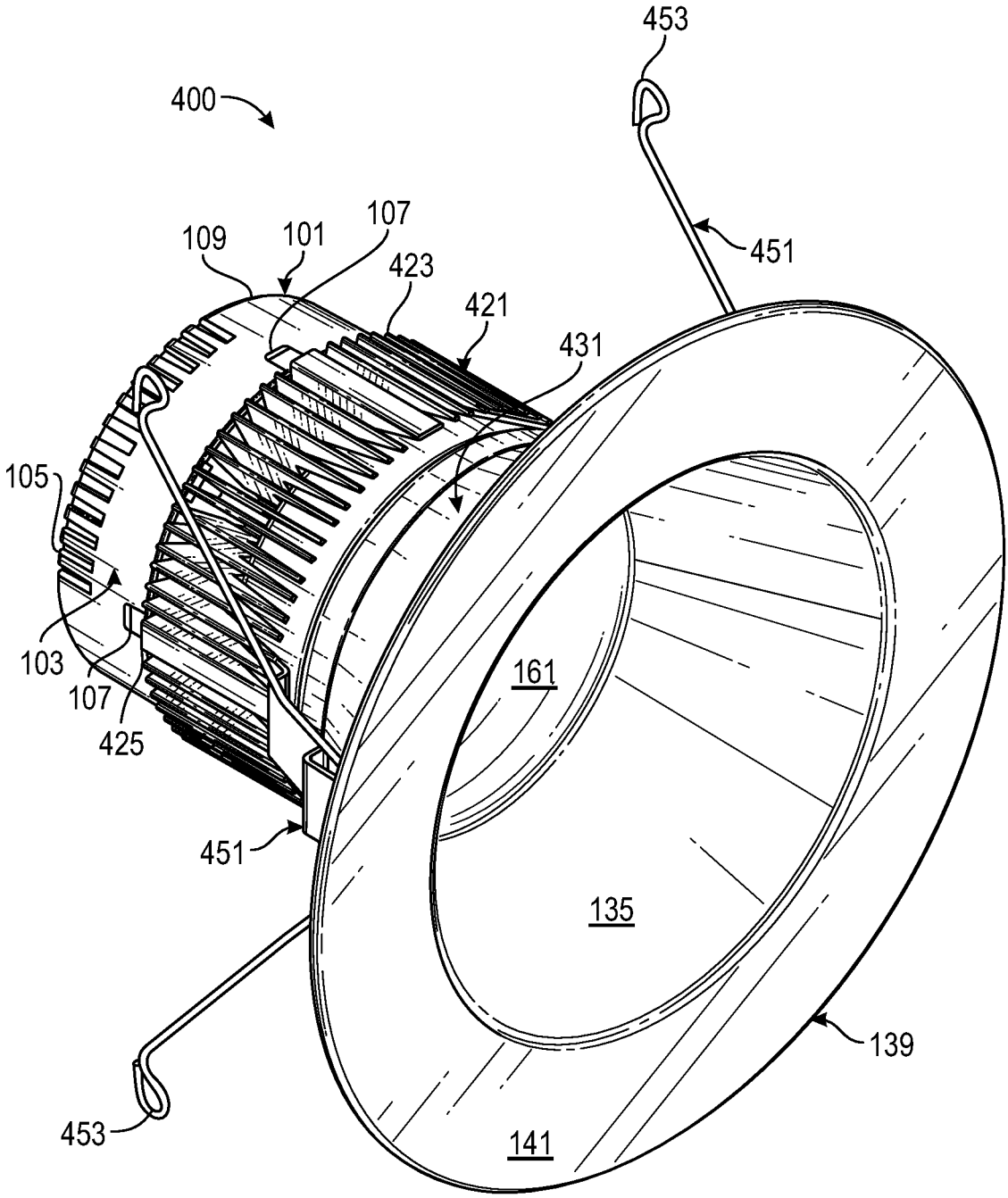
FIG. 4A depicts a bottom perspective view of a light fixture (in an assembled configuration).
Figure 4B:
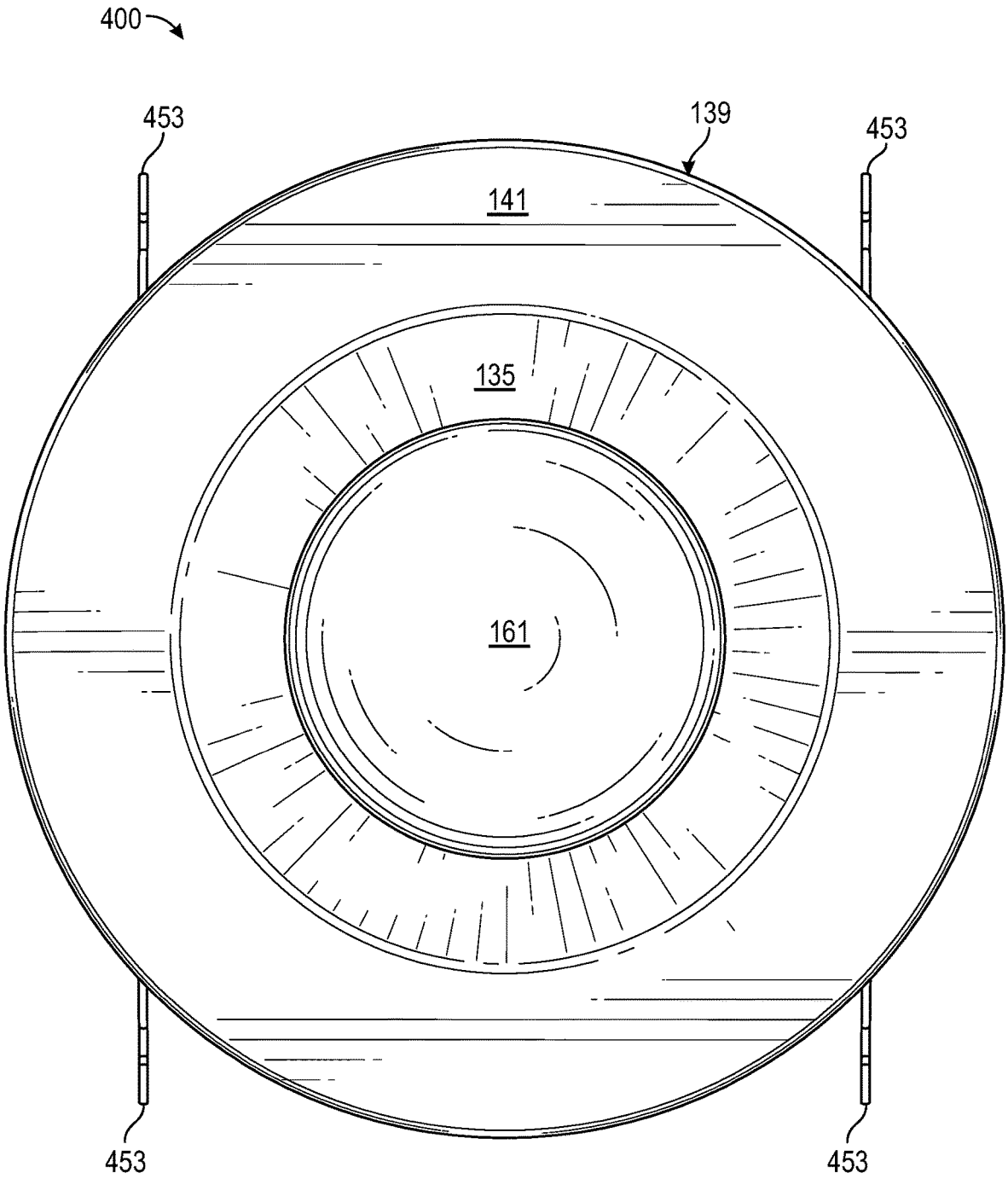
FIG. 4B depicts a bottom view of the light fixture of FIG. 4A (in an assembled configuration).

FIG. 4A depicts a bottom perspective view of a light fixture 400 (in an assembled configuration). FIG. 4B depicts a bottom view of light fixture 400 (in an assembled configuration). In some embodiments, light fixture 400 may comprise: a driver-box 101, a heat-sink 421, a trim-casing 431, a torsion-spring 451, a lens 161, a reflector 251, a LED chip/board 241, a driver-cap 231, a driver-PCB 221, a lumen-switch 211, a color-temperature-switch 213, and a power connector 219.

Continuing discussing FIG. 4A and FIG. 4B, in some embodiments, when light fixture 400 may be in its assembled configuration the following components/parts may be at least partially visible from an exterior of light fixture 400: driver-box 101, heat-sink 421, trim-casing 431, torsion-springs 451, lens 161, wiring/cabling 217, and power connector 219. Note, wiring/cabling 217 and power connector 219 were omitted from FIG. 4A through FIG. 4H but are shown in FIG. 5. With respect to orientation of light fixture 400, a top of light fixture 400 is at top 109 and a bottom of light fixture 400 is at flange 139. In some embodiments, driver-box 101 may be located in a top portion or an upper portion of light fixture 400. In some embodiments, trim/casing 431 may be located from a middle region to a bottom portion or lower portion of light fixture 400. In some embodiments, heat-sink 421 may be disposed between driver-box 101 and trim/casing 431. In some embodiments, lens 161 may be mounted inside of trim/casing 431 and at least partially visible from a bottom of light fixture 400 (see e.g., FIG. 4A and FIG. 4B).

Continuing discussing FIG. 4A, in some embodiments, driver-box 101 may be a substantially hollow cylindrical short member, with a mostly closed top 109, (curving) side-wall 103, and an open bottom. In some embodiments, side-wall 103 may be the side-walls of driver-box 101. In some embodiments, side-wall 103 may be curved, as in a curve of a circle or cylinder side wall. In some embodiments, at least some transverse width cross-sections through driver-box 101 may yield a shape that is substantially circular in shape. In some embodiments, top 109 may be the top (top surface) of driver-box 101. In some embodiments, a hollow interior of driver-box 101 may be configured to receive and/or house at least portions of: lumen-switch 211, color-temperature-switch 213, switch chassis 215, wiring/cabling 217, driver-PCB 221, and driver-cap 231, portions thereof, combinations thereof, and/or the like (see e.g., FIG. 2). In some embodiments, side-wall 103 may be disposed between top 109 and the bottom of driver-box 101. In some embodiments, side-wall 103 may connect the bottom of driver-box 101 to top 109. In some embodiments, located on side-wall 103 may be at least one fin 105. In some embodiments, located on side-wall 103 may be a plurality of fins 105. In some embodiments, fin(s) 105 of side-wall 103 may be configured to emit/transfer heat away from driver-box 101 an into the ambient surrounding air (i.e., the air that may surround light fixture 400). In some embodiments, fin(s) 105 of side-wall 103 may be located on side-wall 103 from an upper one-third of driver-box 101 to an upper one-half of driver-box 101, with respect to a height of driver-box 101 (see e.g., FIG. 4A, FIG. 4D, FIG. 4E, FIG. 4F, FIG. 4G, and FIG. 4H). In some embodiments, lower portions and/or bottom regions of driver-box 101, with respect to a height of driver-box 101 may devoid of fin(s) 105 on side-wall 103 (see e.g., FIG. 4A, FIG. 4D, FIG. 4E, FIG. 4F, FIG. 4G, and FIG. 4H). In some embodiments, fin(s) 105 of side-wall 103 may have tops on and/or visible from top 109, partially around an outside edge of top 109 (see e.g., FIG. 4C).

Continuing discussing FIG. 4A, in some embodiments, heat-sink 421 may be a mostly cylindrical member comprising of a plurality of fins 423/425 that run around the outside side periphery of heat-sink 421. In some embodiments, the plurality of fins 423/425 may be oriented in a radial fashion with respect to a common longitudinal center 201 of light fixture 400. In some embodiments, each fin 423 may be a substantially (mostly) planar member. In some embodiments, each fin 423 may be run up and down (parallel to common longitudinal center 201). In some embodiments, heat-sink 421 may have two different types of fins, fin-thin 423 and fin-thick 425. In some embodiments, fin-thin 423 may be thinner than fin-thick 425. In some embodiments, fin-thick 425 may be thicker than fin-thin 423. In some embodiments, there may be four (4) fins-thick 425. In some embodiments, fins-thin 423 may be more numerous than fins-thick 425.

Continuing discussing FIG. 4A, in some embodiments, trim/casing 431 may be a mostly hollow conical member (i.e., mostly a hollow conical frustum member) that terminates into a flange 139 where trim/casing 431 is at its widest diameter at the bottom of light fixture 400. In some embodiments, trim/casing 431 may be divided into its mostly conical member and its flange 139, with the mostly conical member occupying the top/upper regions of trim/casing 431 and flange 139 occupying the very bottom of trim/casing 431. In some embodiments, side-walls of the conical member of trim/casing 431 may be a conical-exterior 133 and a conical-interior 135. In some embodiments, conical-exterior 133 and conical-interior 135 may be opposite sides/surfaces of the mostly conical member of trim/casing 431. In some embodiments, at least some of conical-interior 135 may be visible from bottom views of light fixture 101. In some embodiments, at least some light emitted from light fixture 400 may shine upon portions of conical-interior 135.

Continuing discussing FIG. 4A, in some embodiments, the mostly conical member of trim/casing 431 may be interrupted by cylindrical-region 137, which may be region of that is more cylindrical than conical. In some embodiments, above and below cylindrical-region 137 may regions of trim/casing 431 that are mostly conical in shape.

Continuing discussing FIG. 4A, in some embodiments, flange 139 may be located at a base of the mostly conical member of trim/casing 431, at the bottom of light fixture 400. In some embodiments, flange 139 may be a mostly planar, flat, disk/disc like, annular member. In some embodiments, flange 139 may comprise flange-bottom 141. In some embodiments, when light fixture may be installed in a ceiling or wall, flange-bottom 141 may be visible overlapping drywall (or the like). In some embodiments, when light fixture may be installed in a ceiling or wall, flange 139 may trim out (cover) a hole cut into the drywall (or the like), wherein this hole may be for receiving can/housing 601 and light fixture 400. In some embodiments, flange-bottom 141 may be visible from bottom views of light fixture 400. In some embodiments, flange-bottom 141 may be a mostly planar, flat, disk/disc like, annular member.

Continuing discussing FIG. 4A, in some embodiments, attached to conical-exterior 133 may be one or more torsion-spring(s) 451. In some embodiments, attached to conical-exterior 133 may be two oppositely disposed torsion-springs 451. In some embodiments, attached to an exterior of trim/casing 431 may be one or more torsion-spring(s) 451. In some embodiments, attached to an exterior of trim/casing 431 may be two oppositely disposed torsion-springs 451. (In some embodiments, attachment of a torsion-spring 451 to trim/casing 431 may be by one or more mechanical fasteners, welding, adhesive, portions thereof, combinations thereof, and/or the like.) In some embodiments, a torsion-spring 451 may comprise two opposing wings 455 that extend and/or protrude away from a center of a torsion-spring 451. In some embodiments, the wings 455 of a given torsion-spring 451 may be configured to removably frictionally grip/engage an interior surface of a can/housing 601, wherein can/housing 601 (see FIG. 6 for can/housing 601) may be configured to removably receive a given light fixture 400.

Continuing discussing FIG. 4A and FIG. 4B, in some embodiments, lens 161 may be configured to permit passage of light. In some embodiments, lens 161 may be substantially optically clear, transparent, translucent, portions thereof, combinations thereof, and/or the like. In some embodiments, lens 161 may be substantially optically clear, transparent, translucent, portions thereof, combinations thereof, and/or the like, with respect to a predetermined range of wavelengths of light, of lumens, of light color-temperatures, portions thereof, combinations thereof, and/or the like. In some embodiments, lens 161 may be curved for a purpose of focusing light passing through and out of lens 161. In some embodiments, lens 161 may be mounted inside of trim/casing 431.

Figure 4C:
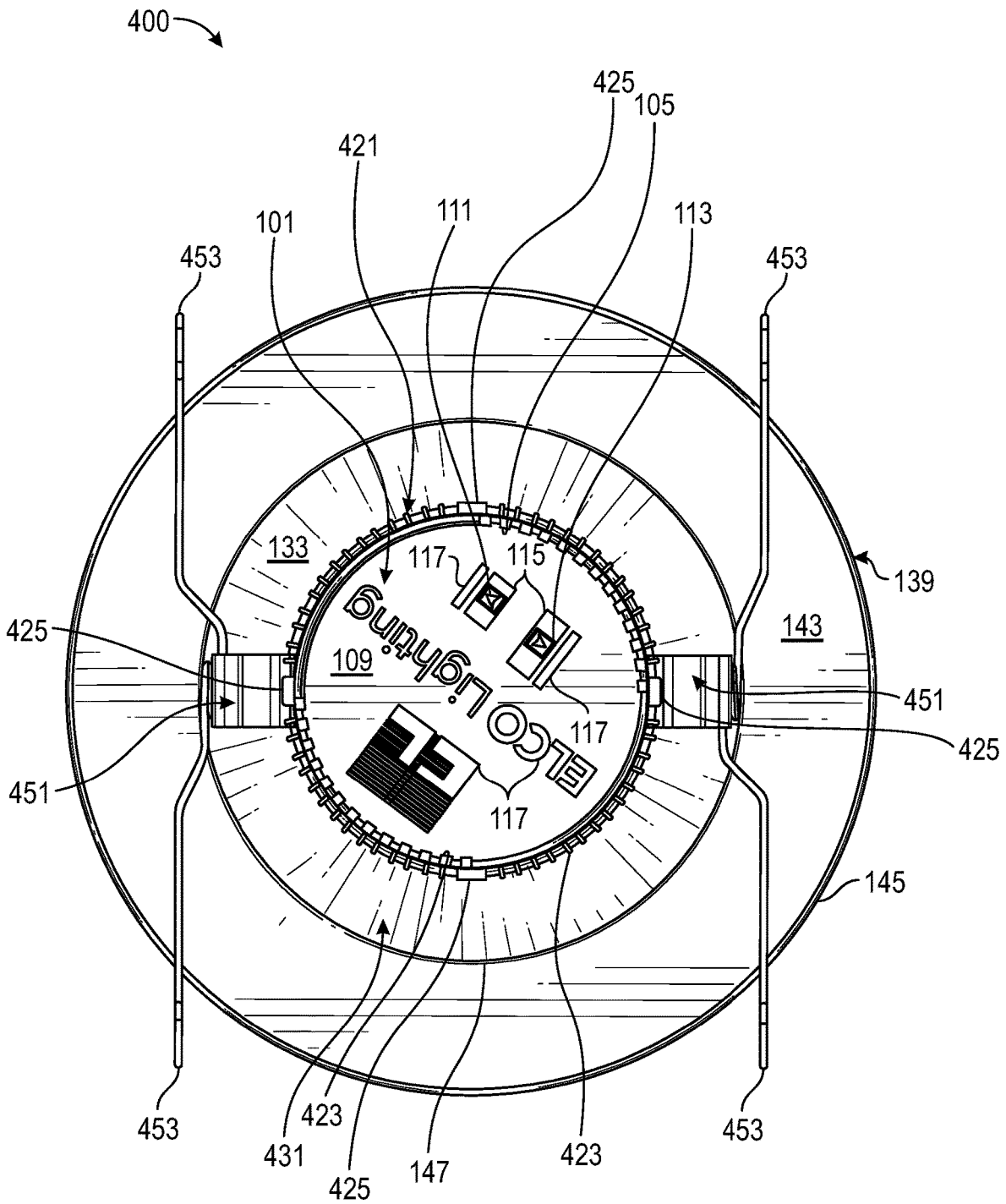
FIG. 4C depicts a top view of the light fixture of FIG. 4A (in an assembled configuration).

FIG. 4C depicts a top view of light fixture 400 (in an assembled configuration). In some embodiments, fins 105 of driver-box 101 may be grouped into two opposing groups of fins 105, separated by two opposing regions of no fins 105. In some embodiments, top 109 may comprise one or more of: lumen-switch-cover 111, color-temperature-switch-cover 113, switch-aperture 115, indicia 117, portions thereof, combinations thereof, and/or the like. In some embodiments, driver-box 101 may comprise two distinct, different, opposing sets of fins 105 configured for heat dissipation. In some embodiments, the two distinct, different, opposing sets of fins 105 may be equally spaced apart from each other by regions of driver-box 101 without fins 105. In some embodiments, each fin 105, selected from the two distinct, different, opposing sets of fins 105 may runs from a side-wall 103 of driver-box 101 to a top 109 of driver-box 101. However, in some embodiments, a bottom portion of driver-box 101 side-wall 103 may have no fins 105.

Continuing discussing FIG. 4C, in some embodiments, lumen-switch-cover 111 may be configured to be removably interacted with by fingers, thumb(s), and/or hand(s) of a user to select lumen output of light fixture 400. In some embodiments, color-temperature-switch-cover 113 may be configured to be removably interacted with by fingers, thumb(s), and/or hand(s) of a user to select light color-temperature output of light fixture 400. In some embodiments, lumen-switch-cover 111 and/or color-temperature-switch-cover 113 may be a membrane cover. In some embodiments, the membrane cover may be water resistant or water proof.

Continuing discussing FIG. 4C, in some embodiments, top 109 may have one or more holes, for example, switch-aperture(s) 115. In some embodiments, switch-aperture 115 may be a hole in top 109. In some embodiments, switch-aperture 115 may be configured to pass and/or receive at least a portion of: lumen-switch-cover 111, color-temperature-switch-cover 113, lumen-switch 211, color-temperature-switch 213, portions thereof, combinations thereof, and/or the like. In some embodiments, there may be one switch-aperture 115 for lumen switching and one switch-aperture 115 for color-temperature switching. In some embodiments, the two switch-apertures 115 may be grouped together side by side.

Continuing discussing FIG. 4C, in some embodiments, top 109 may comprise various indicia 117. In some embodiments, indicia 117 may be one or more of: a logo, a company name, a trademark, a brand, a trade name, a slogan, a catch phrase, a model number, a serial number, a range of selectable lumens, a range of selectable color-temperatures, a registration number, certification information, testing information, standards information, rating information, specification information, a lot number, inspection information, a patent number, patent pending status, a website, a phone number, a mailing address, portions thereof, combinations thereof, and/or the like. In some embodiments, adjacent and next to each switch-aperture 115 may be indicia of a range of selectable lumens and/or a range of selectable color-temperatures. In some embodiments, indicia 117 may be in the form of one or more of: a sticker, printed onto top 109, written onto top 109, painted onto top 109, drawn onto top 109, stenciled onto top 109, engraved onto top 109, carved into top 109, molded directly into top 109, portions thereof, combinations thereof, and/or the like.

Continuing discussing FIG. 4C, in some embodiments, flange 139 may comprise flange-top 143 and flange-lip 145. In some embodiments, flange-top 143 may be an opposing surface with respect to flange-bottom 141. In some embodiments, flange-bottom 141 and flange-top 143 may be different opposing sides/surfaces of flange 139. In some embodiments, when light fixture 400 may be installed in a ceiling and/or wall, flange-top 143 may not be visible. In some embodiments, flange-top 143 may be a mostly planar, flat, disk/disc like, annular member. In some embodiments, towards an outside edge of flange 139 may be flange-lip 145. In some embodiments, flange-lip 145 may be an annular fixed ridge the extends/protrudes orthogonally away from flange-top 143. In some embodiments, flange-conical-transition 147 may indicate where flange 139 begins and the mostly conical member of trim/casing 431 ends. In some embodiments, flange-conical-transition 147 may be relatively smooth. In some embodiments, flange-conical-transition 147 may be devoid of a raised wall/ridge. In some embodiments, the outside diameter of flange 139 may be seven and one-half (7½) inches. In some embodiments, an inside diameter of flange 139 may be five (5) inches. In other embodiments, one or more of these diameter dimensions may be different, but fixed and predetermined.

Figure 4D:
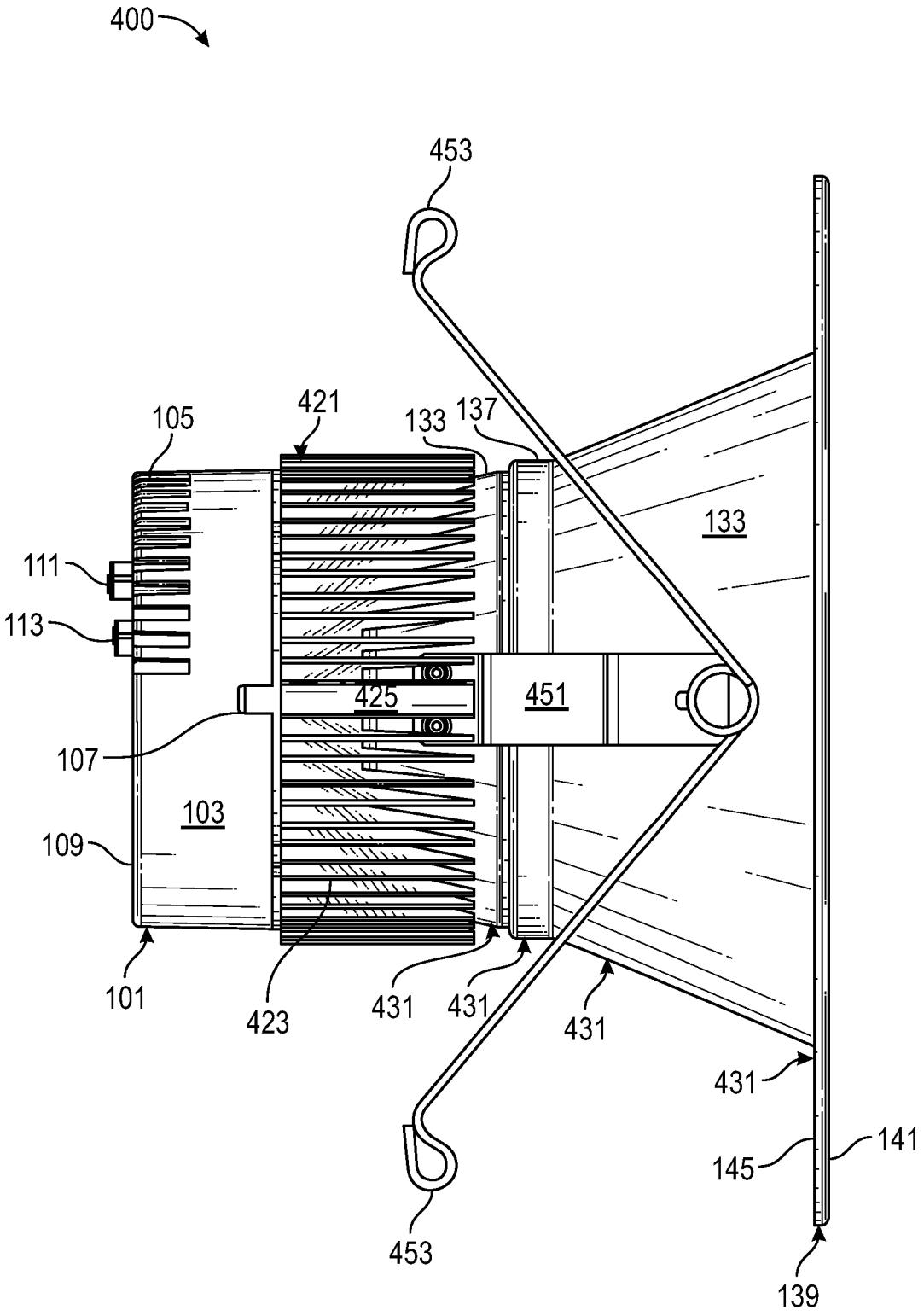
FIG. 4D depicts a right-side view of the light fixture of FIG. 4A (in an assembled configuration).
Figure 4E:
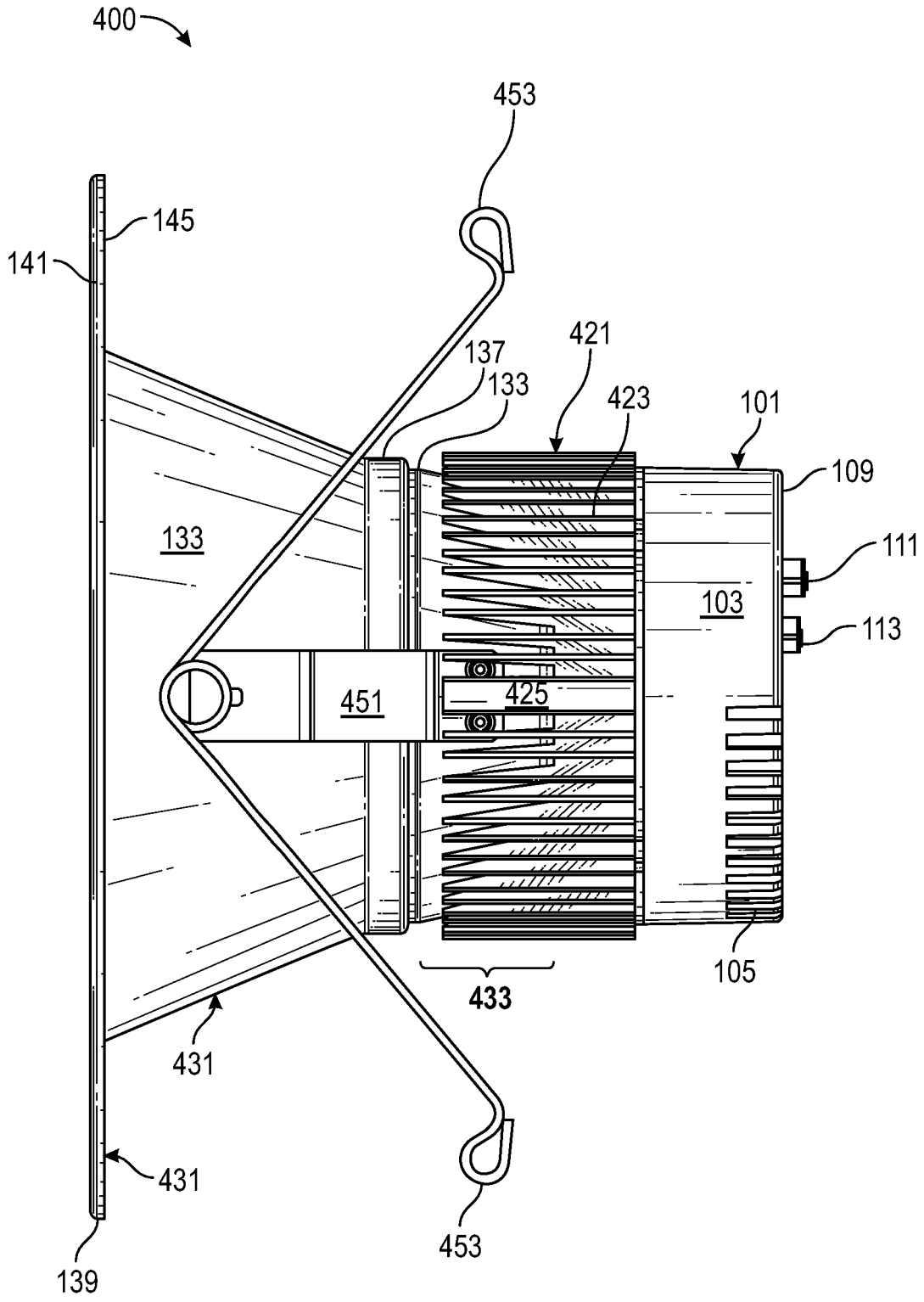
FIG. 4E depicts a left-side view of the light fixture of FIG. 4A (in an assembled configuration).
Figure 4F:
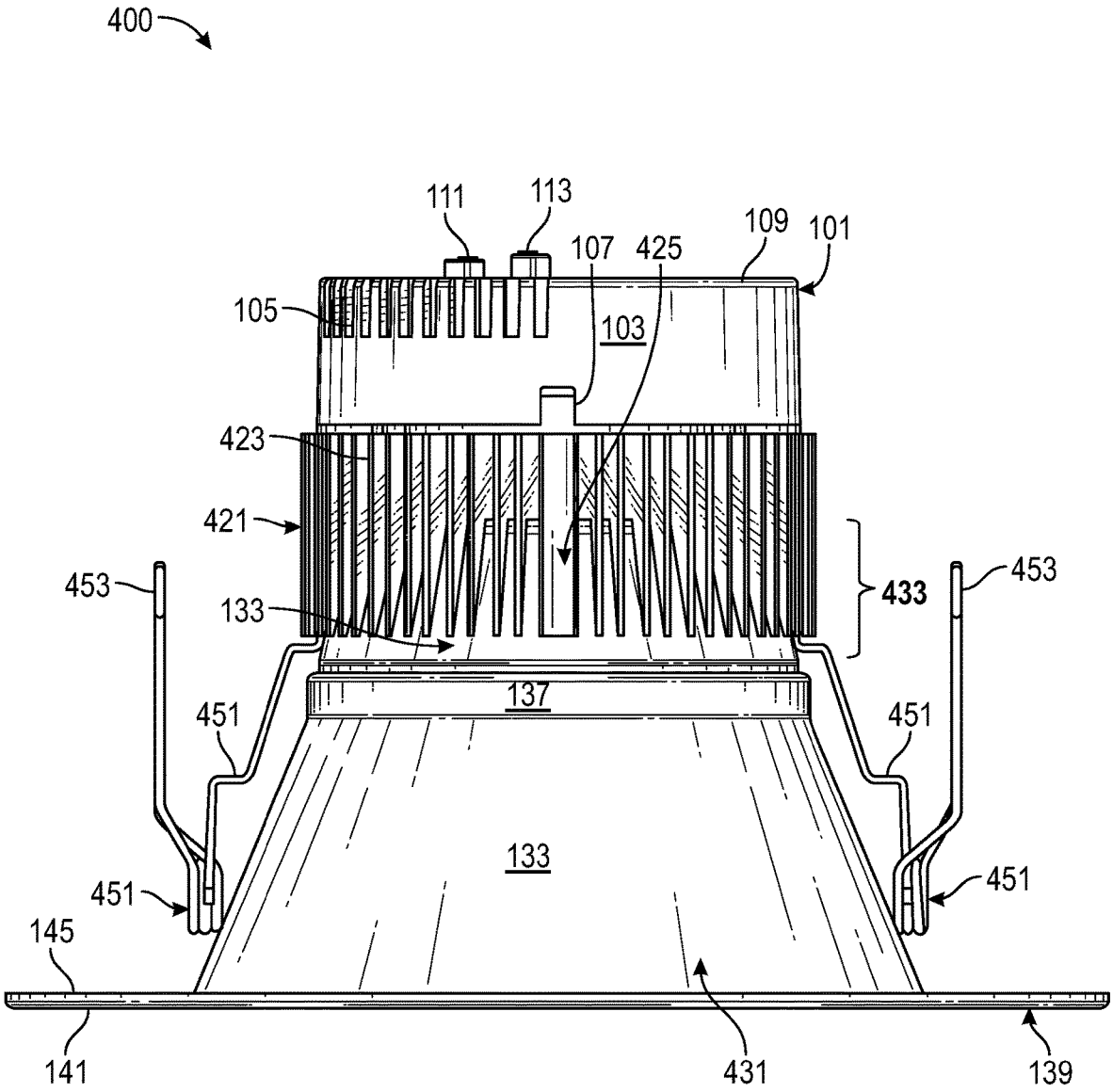
FIG. 4F depicts a front view of the light fixture of FIG. 4A (in an assembled configuration).
Figure 4G:
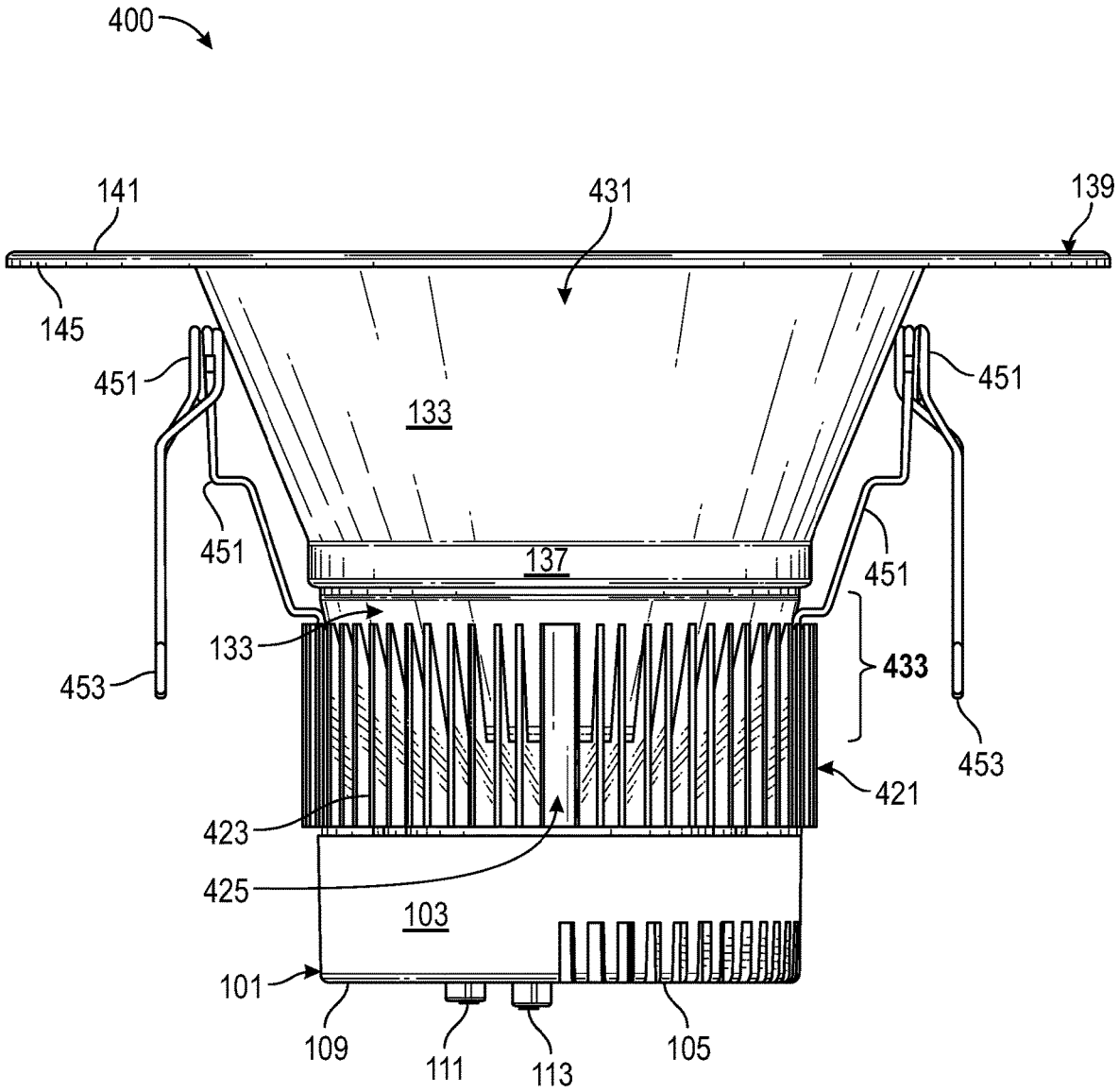
FIG. 4G depicts a rear (back) view of the light fixture of FIG. 4A (in an assembled configuration).

FIG. 4D depicts a right-side view of light fixture 400 (in an assembled configuration). FIG. 4E depicts a left-side view of light fixture 400 (in an assembled configuration). FIG. 4F depicts a front view of light fixture 400 (in an assembled configuration). FIG. 4G depicts a rear (back) view of light fixture 400 (in an assembled configuration). In some embodiments, a total (overall) height of light fixture 400 may be five (5) inches (not including wiring/cabling). In other embodiments, the total (overall) height of light fixture 400 may be a different dimension, but fixed and predetermined.

In some embodiments, at least portions of lumen-switch-cover 111 and/or color-temperature-switch-cover 113 may extend/protrude orthogonally away from top 109 and above top 109. See e.g., FIG. 4D through FIG. 4G.

In some embodiments, side-wall 103 may comprise at least one notch 107. In some embodiments, side-wall 103 may comprise at least two notches 107. In some embodiments, notch 107 may be a notch, a cutout, a hole, an aperture, portions thereof, combinations thereof, and/or the like, in side-wall 103. In some embodiments, notch 107 may be configured and sized for the passage of at least some portions of wiring and/or cabling, such as, but not limited to, wiring/cabling 217. In some embodiments, notch 107 may be located closer to the bottom of driver-box 101 than to top 109. In some embodiments, notch 107 may be extend from the bottom of driver-box 101 towards top 109, but notch 107 may not touch top 109. In some embodiments, notch 107 may be on a bottom one-third to a bottom one-half of driver-box 101. See e.g., FIG. 4E and FIG. 4G.

In some embodiments, an upper-portion 433 of trim/casing 431 may be received inside of heat-sink 421. In some embodiments, upper-portion 433 may be located above cylindrical-region 137. In some embodiments, this upper-portion 433 may include top 263 of trim/casing 431. In some embodiments, bottom interiors of fins 423/425 may be shaped to accommodate upper-portion 433; i.e., fins 423/425 are not entirely rectangular prisms in shape. See e.g., FIG. 4D through FIG. 4G.

In some embodiments, a greatest diameter of light fixture 400 may be an outside diameter of flange 139. In some embodiments, an outside diameter of heat-sink 421 may be larger than an outside diameter of driver-box 101. In some embodiments, the outside diameter of heat-sink 421 may be larger than an outside diameter of cylindrical-region 137 of the mostly conical member of trim/casing 431. See e.g., FIG. 4D through FIG. 4G.

In some embodiments, cylindrical-region 137 may be located about two (2) inches from flange 139/flange-bottom 141. See e.g., FIG. 4D through FIG. 4G.

In some embodiments, the fins 423/425 of heat-sink 421 may run from a bottom of heat-sink 421 to a top of heat-sink 421. See e.g., FIG. 4D through FIG. 4G.

Figure 4H:
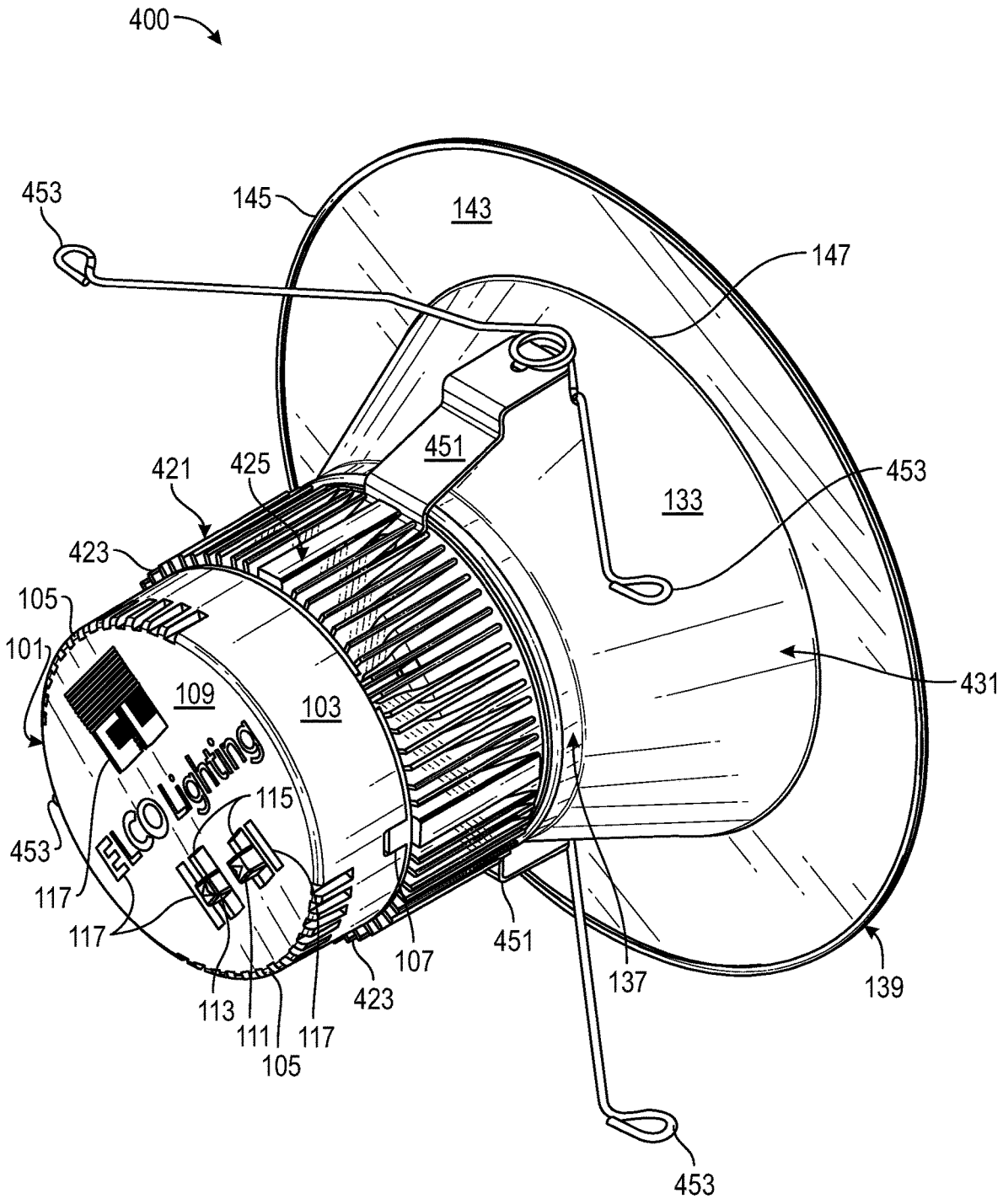
FIG. 4H depicts a top perspective view of the light fixture of FIG. 4A (in an assembled configuration).

FIG. 4H depicts a top perspective view of light fixture 400 (in an assembled configuration).

FIG. 5 depicts a top perspective exploded view of light fixture 400. FIG. 5 may show common longitudinal center 201 of light fixture 400. In some embodiments, common longitudinal center 201 is also an imaginary central axis of light fixture 400 wherein the main component parts are exploded along this imaginary line in FIG. 5.

Continuing discussing FIG. 5, in some embodiments, light fixture 400 may be configured for mounting within a given can/housing 601 (see e.g., FIG. 6). In some embodiments, light fixture 400 may comprise a driver assembly, heat-sink 421, and a trim-casing assembly.

Continuing discussing FIG. 5, in some embodiments, the driver assembly may comprise driver-PCB 221, lumen-switch 211, color-temperature-switch 213, and driver-box 101. In some embodiments, driver-PCB 221, lumen-switch 211, and color-temperature-switch 213 may be at least mostly housed within driver-box 101. In some embodiments, driver-PCB 221 may be configured to provide electrical power and/or to control LED-chip-board 241. In some embodiments, lumen-switch 211 may be configured to change a lumen output of LED-chip/board 241. In some embodiments, color-temperature-switch 213 may be configured to change a light color-temperature output of LED-chip/board 241.

Continuing discussing FIG. 5, in some embodiments, the driver assembly may further comprise lumen-switch-cover 111 and color-temperature-switch-cover 113. In some embodiments, lumen-switch-cover 111 may cover over the lumen-switch 211. In some embodiments, lumen-switch-cover 111 may be in physical communication with the lumen-switch 211. In some embodiments, color-temperature-switch-cover 113 may cover over color-temperature-switch 213. In some embodiments, color-temperature-switch-cover 113 may be in physical communication with the color-temperature-switch 213. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of driver-box 101. In some embodiments, at least a portion of the lumen-switch-cover 111 and at least a portion of the color-temperature-switch-cover 113 may be both configured to be engaged (i.e., switched to different positions) by a finger, a thumb, and/or a hand of a user.

Continuing discussing FIG. 5, in some embodiments, the driver assembly may further comprise one or more of: lumen-switch-cover 111, color-temperature-switch-cover 113, switch chassis 215, wiring/cabling 217, power connector 219, driver-cap 231, portions thereof, combinations thereof, and/or the like.

Continuing discussing FIG. 5, in some embodiments, the trim-casing assembly may comprise LED-chip/board 241, reflector 251, lens 161, a can-attachment-means, and trim/casing 431. In some embodiments, LED-chip/board 241, reflector 251, and lens 161 may be housed within trim/casing 431. In some embodiments, LED-chip/board 241 may be configured to output light of a predetermined luminosity and of a predetermined light color-temperature. In some embodiments, the can-attachment-means may be mounted to an exterior of trim/casing 431. In some embodiments, the can-attachment-means may be configured to removably mount light fixture 400 within can/housing 601. In some embodiments, the can-attachment-means may be one or more of: pressure-clip 151, torsion-spring 451, combinations thereof, and/or the like.

Continuing discussing FIG. 5, in some embodiments, lumen-switch 211, color-temperature-switch 213, and LED-chip/board 241 may all be operatively connected to driver-PCB 221. In some embodiments, heat-sink 421 may be disposed below the driver assembly and at least mostly above the trim-casing assembly.

Continuing discussing FIG. 5, in some embodiments, when light fixture 400 may be assembled, switch chassis 215, driver-PCB 221, and driver-cap 231 may be located at least mostly to entirely within the hollow interior of driver-box 101. In some embodiments, when light fixture 400 may be assembled, lumen-switch 211 and color-temperature-switch 213 may be located at least partially within the hollow interior of driver-box 101. In some embodiments, switch chassis 215 may be a structural member wherein lumen-switch 211 and/or color-temperature-switch 213 are attached thereto. In some embodiments, switch chassis 215 may be a mostly circular disc like member. In some embodiments, switch chassis 215 may comprise circuitry, wiring, cabling, wiring/cabling 217, switches, lumen-switch 211, color-temperature-switch 213, portions thereof, combinations thereof, and/or the like. In some embodiments, driver-PCB 221 may be a printed circuit board. In some embodiments, driver-PCB 221 may comprise one or more circuits. In some embodiments, driver-PCB 221 may be configured for lighting/LED driver, control, management, and/or regulation functions. In some embodiments, driver-PCB 221 may have a power factor greater than 0.9 and a start time of less than 0.75 seconds. In some embodiments, driver-PCB 221 may be electrically coupled to: lumen-switch 211, color-temperature-switch 213, wiring/cabling 217, power connector 219, LED-chip/board 241, wiring, cabling, portions thereof, combinations thereof, and/or the like. In some embodiments, driver-cap 231 may cover over the bottom of driver-box 101. In some embodiments, driver-cap 231 may be removably attached to the bottom of driver-box 101 and/or to a top of heat-sink 421. In some embodiments, driver-cap 231 may be a mostly planarly flat plate disc like member (with hole(s) for wire passage and/or for mechanical fasteners).

Continuing discussing FIG. 5, in some embodiments, light fixture 400 may comprise wiring/cabling 217. In some embodiments, wiring/cabling 217 may be configured for electrical power transmission. In some embodiments, wiring/cabling 217 may terminate in power connector 219. In some embodiments, wiring/cabling 217 may also terminate at lumen-switch 211, color-temperature-switch 213, switch chassis 215, portions thereof, combinations thereof, and/or the like. In some embodiments, power connector 219 may be configured to be removably attached to a complimentary power connector (e.g., power source 603), so that light fixture 400 may receive electrical power for operation. In some embodiments, light fixture 400 may comprise other wiring and/or cabling in addition to wiring/cabling 217.

Continuing discussing FIG. 5, in some embodiments, light fixture 400 may be configured for operation at predetermined voltage and/or wattage. For example, and without limiting the scope of the present invention, in some embodiments, light fixture 400 may be configured for operation at 120 volts, 9.5 watts, 13.5 watts, and/or 18 watts. In other embodiments, light fixture 400 may be configured for operating at other voltages and/or wattages.

Continuing discussing FIG. 5, in some embodiments, lumen-switch-cover 111 may cover over a below located lumen-switch 211. In some embodiments, lumen-switch-cover 111 may be in physical communication with below located lumen-switch 211. In some embodiments, color-temperature-switch-cover 113 may cover over a below located color-temperature-switch 213. In some embodiments, color-temperature-switch-cover 113 may be in physical communication with below color-temperature-switch 213.

Continuing discussing FIG. 5, in some embodiments, lumen-switch 211 may be a switch configured to change the luminosity of emitted light from LED-chip/board 241, within a predetermined range of luminosity (e.g., in lumens). In some embodiments, lumen-switch 211 may be configured to select lumens output from 1000 to 2000 lumens. In some embodiments, lumen-switch 211 may be configured to select lumens output at 1000 lumens, 4250 lumens, 1500 lumens, 1750 lumens, and/or 2000 lumens. In some embodiments, lumen-switch 211 may be configured to select lumens output from 500 to 3000 lumens or some whole number subset range thereof. In other embodiments, other predetermined lumens may be selected (selectable) by lumen-switch 211.

Continuing discussing FIG. 5, in some embodiments, color-temperature-switch 213 may be a switch configured to change the emitted light color-temperature from LED-chip/board 241, within a predetermined range of light color-temperatures (e.g., in Kelvin). In some embodiments, color-temperature-switch 213 may be configured to select light color-temperatures from 2700 Kelvin to 5000 Kelvin. In some embodiments, color-temperature-switch 213 may be configured to select light color-temperatures at 2700 Kelvin, 3000 Kelvin, 3500 Kelvin, 4000 Kelvin, and/or 5000 Kelvin. In other embodiments, other predetermined light color-temperatures may be selected (selectable) by color-temperature-switch 213.

Continuing discussing FIG. 5, in some embodiments, heat-sink 421 may be configured to receive heat from electronic components of light fixture 400 and to then dissipate this received heat into the surrounding ambient air. In some embodiments, the electronic components of light fixture 400 that may generate and/or emit heat may be one or more of: LED-chip/board 241, driver-PCB 221, lumen-switch 211, color-temperature-switch 213, wiring/cabling 217, power connector 219, portions thereof, combinations thereof, and/or the like. In some embodiments, a center of heat-sink 421 may be devoid of fins 423/425. In some embodiments, a center of heat-sink 421 may be devoid of material, i.e., the center may be void space (however upper-portion 433 receive into this otherwise void space and wiring [not shown] may pass through this otherwise void space). In some embodiments, the four fins-thick 425 may be equally spaced around heat-sink 421 with respect to the common longitudinal center 201 of light fixture 400; with a plurality of fins-thin 423 disposed between each fin-thick 425, such that there are four distinct regions (quadrants) of fins-thin 423 (see e.g., FIG. 5). In some embodiments, heat-sink 421 may comprise four fins-thick 425 and four groups of fins-thin 423. In some embodiments, each group of fins-thin 423 may be disposed two different of fins-thick 425. In some embodiments, all of fins-thick 425 and all of fins-thin 423 may be arranged radially around a common longitudinal center line 201 of light fixture 400. In some embodiments, all of fins-thick 425 and all of fins-thin 423 may have a same (exterior) height from a bottom of heat-sink 421 to a top of heat-sink 421. In some embodiments, an exterior of heat-sink 421 from a bottom of heat-sink 421 to a top of heat-sink 421 may be substantially cylindrical in shape with a same outer diameter up and down that exterior. In some embodiments, the exterior of heat-sink 421 may be devoid of any steps. In some embodiments, the exterior of heat-sink 421 may be devoid of threading for attachment to trim/casing 431. In some embodiments, a fin-thick 425 may have a hole, wherein such a hole may be configured for receiving a screw, post, bolt, pin, mechanical fastener, portions thereof, combinations thereof, and/or the like, wherein this hole runs in a vertical direction, parallel to the common longitudinal center 201 of light fixture 400 (see e.g., FIG. 5).

Continuing discussing FIG. 5, in some embodiments, trim/casing 431 may comprise a substantially conical frustum member that has a mostly closed top 263 and an open base. In some embodiments, the substantially conical frustum member may be interrupted by cylindrical-region 137 that is more cylindrical than conical, wherein a portion above the cylindrical-region of trim/casing 431 is conical and a portion below cylindrical-region 137 of trim/casing 431 is conical. In some embodiments, lens 161 may be housed within cylindrical-region 137 of trim/casing 431. In some embodiments, reflector 251 and LED-chip/board 241 may be both housed above lens 161 in an upper-portion 261 of trim/casing 431 that is conical. In some embodiments, an upper-portion 433 of trim/casing 431 may extend into an inside bottom portion of heat-sink 421. In some embodiments, upper-portion 433 of trim/casing 431 may run from cylindrical-region 137 to top 263 of trim/casing 431.

Continuing discussing FIG. 5, in some embodiments, cylindrical-region 137 may be sized and configured to removably receive lens 161 inside of cylindrical-region 137. In some embodiments, when light fixture 400 may be assembled, above lens 161 and inside of an upper-portion 261 of the mostly conical member of trim/casing 431 may be reflector 251 and LED-chip/board 241. In some embodiments, upper-portion 261 may be located between a top 263 of trim/casing 431 and cylindrical-region 137. In some embodiments, LED-chip/board 241 may be located on top of reflector 251 within upper-portion 261. In some embodiments, LED-chip/board 241 may be located closer to top 263 as compared to reflector 251. In some embodiments, top 263 may be mostly planarly flat and closed, aside from at least one hole. In some embodiments, hole(s) in top 263 may be configured for passage/receiving of portions of wires/cables; and/or for attaching trim/casing 431 to heat-sink 421 via mechanical fasteners, screws, bolts, pins, rods, and/or the like. In some embodiments, upper-portion 433 of trim/casing 431 (e.g., top 263) may be received into (inside of) a bottom portion of heat-sink 421 (see e.g., FIG. 4D through FIG. 4H). (Note, in some embodiments, light fixture 100 does not have this configuration with respect to its heat-sink 121.) In some embodiments, top 263 may be constructed of a material that conducts heat well from top 263 and into heat-sink 421. In some embodiments, thermal-paste (or the like) may be located on a bottom of heat-sink 421 and top 263 to facilitate/promote heat transfer from top 263 and into heat-sink 421.

Continuing discussing FIG. 5, in some embodiments, LED-chip/board 241 may be a light source. In some embodiments, LED-chip/board 241 may be electrically powered. In some embodiments, when LED-chip/board 241 may be sufficiently electrically powered, LED-chip/board 241 may emit light. In some embodiments, when LED-chip/board 241 may be sufficiently electrically powered, LED-chip/board 241 may emit light down through reflector 251 and out of a bottom of light fixture 400. In some embodiments, LED-chip/board 241 may comprise one or more LEDs (light emitting diodes) and/or other types of light sources. In some embodiments, LED-chip/board 241 may comprise one or more LEDs (light emitting diodes) of different colors. In some embodiments, LED-chip/board 241 may comprise one or more printed circuit boards. In some embodiments, LED-chip/board 241 may comprise one or more circuits. In some embodiments, LED-chip/board 241 may be dimmable. In some embodiments, LED-chip/board 241 may be electrically coupled to driver-PCB 221, lumen-switch 211, color-temperature-switch 213, switch chassis 215, wiring/cabling 217, power connector 219, portions thereof, combinations thereof, and/or the like.

Continuing discussing FIG. 5, in some embodiments, LED-chip/board 241 may output lumens at a predetermined value. In some embodiments, LED-chip/board 241 may output lumens from a predetermined range of lumens. In some embodiments, LED-chip/board 241 may output lumens from 1000 to 2000 lumens. In some embodiments, LED-chip/board 241 may output lumens at 1000 lumens, 4250 lumens, 1500 lumens, 1750 lumens, and/or 2000 lumens. In some embodiments, LED-chip/board 241 may output lumens from 500 to 3000 lumens or some whole number subset thereof. In other embodiments, other predetermined lumens may be output by LED-chip/board 241.

Continuing discussing FIG. 5, in some embodiments, LED-chip/board 241 may output light color-temperature at a predetermined value (e.g., in Kelvins). In some embodiments, LED-chip/board 241 may output light color-temperature from 2700 Kelvin to 5000 Kelvin. In some embodiments, LED-chip/board 241 may output light color-temperatures at 2700 Kelvin, 3000 Kelvin, 3500 Kelvin, 4000 Kelvin, and/or 5000 Kelvin. In other embodiments, other predetermined light color-temperatures may be output by LED-chip/board 241.

Continuing discussing FIG. 5, in some embodiments, reflector 251 may be a highly reflective conical frustum member. In some embodiments, at least an interior surface of reflector 251 that faces a bottom of light fixture 400 may have a substantially minor like reflective finish. In some embodiments, reflector 251 may be configured to reflect at least some light emitted by LED-chip/board 241. In some embodiments, reflector 251 may be configured to reflect at least some light emitted by LED-chip/board 241 downwards and out of a bottom of light fixture 400.

FIG. 6 depicts light fixture 600 connected and ready for installation into a can/housing 601, from a side view. In some embodiments, can/housing 601 might be mounted within a ceiling and/or a wall of building, such as, but not limited to, a residence and/or a commercial building. And thus, light fixture 400 may be mounted mostly (aside from flange 139) within the ceiling and/or the wall of that building. In some embodiments, light fixture 400 may be sized for a particular size and/or style of can/housing 601. In some embodiments, can/housing 601 may be sized for a particular size of light fixture 400. In some embodiments, can/housing 601 may be a five (5) inch or six (6) inch (or other sized) ICA housing (such as for new construction, remodel, and/or with a particular fire hour rating). FIG. 6 shows that power connector 219 may be removably attached to power source 603, wherein power source 603 may be associated with can/housing 601. For example, and without limiting the scope of the present invention, power source 603 might be a 120-volt AC source (e.g., from a 15-amp or a 20-amp circuit) that may be feeding can/housing 601.

In some embodiments, heat-sink 121 and/or heat-sink 421 may be substantially constructed from one or more materials that are generally used for heat conduction. In some embodiments, heat-sink 121 and/or heat-sink 421 may be substantially constructed from one or more materials that have generally high heat conductivity. In some embodiments, heat-sink 121 and/or heat-sink 421 may be substantially constructed from one or more metals.

In some embodiments, fin-thick 125/425 may be configured to function and/or operate as a mounting block with a substantially vertical through-hole.

In some embodiments, in light fixture 100, pressure-clips 151 may be replaced with torsion-springs 451. In some embodiments, in light fixture 400, torsion-springs 451 may be replaced with pressure-clips 151.

In some embodiments, lumen-switch 211 (and its cover 111) as shown in the drawing figures may be switched (swapped) with color-temperature-switch 213 (and its cover 113); and vice-versa. In some embodiments, a given switch-aperture 115 may receive at least portions of a lumen-switch 211 (and its cover 111) or of a color-temperature-switch 213 (and its cover 113). In some embodiments, switch-aperture 115, lumen-switch 211 (and its cover 111), and/or color-temperature-switch 213 (and its cover 113) may be located on side-wall 103 of driver-box 101.

In some embodiments, adjacent to each switch-aperture 115 may be indicia 117 of the available lumens and/or color-temperatures that may be selected. In some embodiments, a top of lumen-switch-cover 111 and/or a top of color-temperature-switch-cover 113 may comprise an arrow that points to the currently selected lumen output and/or that points to the currently selected color-temperature output.

In some embodiments, each indicia 117 for each switch-aperture 115 may be located to a right of the respective 115. In some embodiments, each indicia 117 for each switch-aperture 115 may be located to a left of the respective 115. In some embodiments, an indicia 117 for a given switch-aperture 115 may be located between two adjacent switch-apertures 115 (see e.g., FIG. 1C).

In some embodiments, the two switch-apertures 115 may be adjacent and side by side to each other and each such switch-aperture 115 may have a single indicia 117 associated next to that switch-aperture 115, but between the two adjacent side by side switch-apertures 115 there may be no indicia 117 (see e.g., FIG. 4C).

In some embodiments, lumen-switch-cover 111 and color-temperature-switch-cover 113, lumen-switch 211 and color-temperature-switch 213, and/or switch-apertures 115 may be side by side (adjacent to each other), such that the user with a single finger may removably engage both lumen-switch-cover 111 and color-temperature-switch-cover 113 together at the same time.

In some embodiments, lumen-switch-cover 111 and color-temperature-switch-cover 113, lumen-switch 211 and color-temperature-switch 213, and/or switch-apertures 115 may be side by side (adjacent to each other), such that the user with a single finger may removably engage both lumen-switch 211 and color-temperature-switch 213 together at the same time.

In some embodiments, switch-aperture 115 for color-temperature-switch-cover 113 may be longer than switch-aperture 115 for lumen-switch-cover 111. In some embodiments, switch-aperture 115 for lumen-switch-cover 111 may be longer than switch-aperture 115 for color-temperature-switch-cover 113.

In some embodiments, can/housing 301 and/or can/housing 601 may be referred to as a "housing-can."

In some embodiments, trim/casing 131 and/or trim/casing 431 may be referred to as a "trim-casing-member."

In some embodiments, driver-PCB 221 may be referred to as a "driver-printed-circuit-board."

In some embodiments, LED chip-board 241 may be referred to as a "light-emitting-diode-circuit."

In some embodiments, pressure-clip 151 and/or torsion-spring 451 may be referred to as "can-attachment-means."

Light fixtures have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A light fixture configured for mounting within a housing-can, wherein the light fixture comprises:

a driver assembly, wherein the driver assembly comprises a driver-printed-circuit-board, a lumen-switch, a color-temperature-switch, and a driver-box; wherein the driver-printed-circuit-board, the lumen-switch, and the color-temperature-switch are at least mostly housed within the driver-box; wherein the driver-printed-circuit-board is configured to provide electrical power and to control a light-emitting-diode-circuit; wherein the lumen-switch is configured to change a lumen output of the light-emitting-diode-circuit; wherein the color-temperature-switch is configured to change a light color-temperature output of the light-emitting-diode-circuit;

a heat-sink; and a trim-casing assembly, wherein the trim-casing assembly comprises the light-emitting-diode-circuit, a reflector, a lens, a can-attachment-means, and a trim-casing-member; wherein the light-emitting-diode-circuit, the reflector, and the lens are housed within the trim-casing-member; wherein the light-emitting-diode-circuit is configured to output light of a predetermined luminosity and of a predetermined light color-temperature; wherein the can-attachment-means is mounted to an exterior of the trim-casing member, wherein the can-attachment-means is configured to removably mount the light fixture within the housing-can;

wherein the lumen-switch, the color-temperature-switch, and the light-emitting-diode-circuit are all operatively connected to the driver-printed-circuit-board; and wherein the heat-sink is disposed below the driver assembly and at least mostly above the trim-casing assembly.

2. The light fixture according to claim 1, wherein at least a portion of the lumen-switch and at least a portion of the color-temperature-switch both extend and protrude orthogonally away from an exterior surface of the driver-box.

3. The light fixture according to claim 1, wherein the driver assembly further comprises a lumen-switch-cover and a color-temperature-switch-cover; wherein the lumen-switch-cover covers over the lumen-switch; wherein the lumen-switch-cover is in physical communication with the lumen-switch; wherein the color-temperature-switch-cover covers over the color-temperature-switch; wherein the color-temperature-switch-cover is in physical communication with the color-temperature-switch.

4. The light fixture according to claim 3, wherein the lumen-switch-cover and the color-temperature-switch-cover are both waterproof.

5. The light fixture according to claim 3, wherein at least a portion of the lumen-switch-cover and at least a portion of the color-temperature-switch-cover are both configured to be engaged by a finger, a thumb, and/or a hand of a user.

6. The light fixture according to claim 1, wherein the lumen-switch is configured to select the lumen output from a range of 500 lumens to 3000 lumens.

7. The light fixture according to claim 1, wherein the color-temperature-switch is configured to select the light color-temperature output from a range of 2700 Kelvin to 5000 Kelvin.

8. The light fixture according to claim 1, wherein the driver-box comprises two distinct, different, opposing sets of fins configured for heat dissipation; wherein the two distinct, different, opposing sets of fins are equally spaced apart from each other by regions of the driver-box without fins.

9. The light fixture according to claim 8, wherein each fin, selected from the two distinct, different, opposing sets of fins, runs from a side-wall of the driver-box to a top of the driver-box.

10. The light fixture according to claim 1, wherein the heat-sink comprises four thick fins and four groups of thin fins, wherein each group of thin fins is disposed two of the thick fins, wherein the thick fins are thicker than the thin fins; and wherein all of the thick fins and all of the thin fins are arranged radially around a common longitudinal center line of the light fixture.

11. The light fixture according to claim 10, wherein all of the thick fins and all of the thin fins have a same height from a bottom of the heat-sink to a top of the heat-sink.

12. The light fixture according to claim 1, wherein an exterior of the heat-sink from a bottom of the heat-sink to a top of the heat-sink is substantially cylindrical in shape with a same outer diameter.

13. The light fixture according to claim 1, wherein the trim-casing-member comprises a substantially conical frustum member that has a mostly closed top and an open base, wherein the substantially conical frustum member is interrupted by a cylindrical-region that is more cylindrical than conical, wherein a portion above the cylindrical-region of the trim-casing-member is conical and a portion below the cylindrical-region of the trim-casing-member is conical.

14. The light fixture according to claim 13, wherein the lens is housed within the cylindrical-region of the trim-casing-member.

15. The light fixture according to claim 14, wherein the reflector and the light-emitting-diode-circuit are both housed above the lens in an upper-portion of the trim-casing-member that is conical.

16. The light fixture according to claim 13, wherein an outside diameter of the cylindrical-region of the trim-casing-member is the same as an outside diameter of the heat-sink.

17. The light fixture according to claim 1, wherein the trim-casing-member does not extend into a bottom of the heat-sink.

18. The light fixture according to claim 1, wherein an upper-portion of the trim-casing-member extends into an inside bottom portion of the heat-sink.

19. The light fixture according to claim 1, wherein the can-attachment-means is one or more of: a pressure-clip and/or a torsion-spring.

* * * * *